US010550566B2

(12) United States Patent
Berkowitz et al.

(10) Patent No.: US 10,550,566 B2
(45) Date of Patent: Feb. 4, 2020

(54) STRUCTURE AND METHOD OF MAKING THE SAME

(71) Applicant: SKYRISE GLOBAL, LLC, Coconut Grove, FL (US)

(72) Inventors: Jeffrey Berkowitz, Miami, FL (US); Bernardo Fort-Brescia, Miami, FL (US); Ronald Klemencic, Seattle, WA (US)

(73) Assignee: Skyrise Global, LLC, Coconut Grove, FL (US)

( * ) Notice: Subject to any disclaimer, the term of this patent is extended or adjusted under 35 U.S.C. 154(b) by 0 days.

(21) Appl. No.: 15/711,253

(22) Filed: Sep. 21, 2017

(65) Prior Publication Data

US 2018/0080214 A1 Mar. 22, 2018

Related U.S. Application Data

(60) Provisional application No. 62/397,681, filed on Sep. 21, 2016.

(51) Int. Cl.
*A63G 31/00* (2006.01)
*E04B 1/30* (2006.01)
(Continued)

(52) U.S. Cl.
CPC ..... *E04B 1/30* (2013.01); *A63G 7/00* (2013.01); *A63G 31/00* (2013.01); *A63G 31/10* (2013.01); *E04B 1/16* (2013.01); *E04B 1/161* (2013.01); *E04B 1/19* (2013.01); *E04B 1/24* (2013.01); *E04B 1/343* (2013.01); *E04B 1/34823* (2013.01); *E04B 1/3511* (2013.01); *E04H 3/00* (2013.01); *A63G 21/04* (2013.01);
(Continued)

(58) Field of Classification Search
CPC . A63G 1/00; A63G 1/08; A63G 21/00; A63G 21/10; A63G 21/12; A63G 27/00; A63G 31/00; A63G 31/02
USPC ..... 472/43, 59, 130, 136; 104/53, 56
See application file for complete search history.

(56) References Cited

U.S. PATENT DOCUMENTS 738,581 A 9/1903 Terry et al.
1,337,873 A 4/1920 Zeman
(Continued)

FOREIGN PATENT DOCUMENTS

DE 1484083 12/1968
FR 2219282 9/1974
(Continued)

OTHER PUBLICATIONS

STERPIS. Megastructures National Geographic, Dubai Palace hotel (greek subs), Apr. 8, 2014 (Apr. 8, 2014) [retrieved on Oct. 31, 2017]. Retrieved from the Internet. <URL https://www.youtube.com/watch?v=JLc9LJPxYLI> entire video. See pp. 6-17 of the ISA/237.
(Continued)

*Primary Examiner* — Kien T Nguyen
(74) *Attorney, Agent, or Firm* — Brian J. Colandreo; Jeffrey T. Placker; Holland & Knight LLP

(57) ABSTRACT

An vertical entertainment structure includes: an offset core; a moment stabilizing structure; a plurality of floor plate assemblies; and two or more entertainment rides that each span at least two of the plurality of floor plate assemblies.

20 Claims, 32 Drawing Sheets

(51) Int. Cl.

| | |
|---|---|
| ***E04B 1/16*** | (2006.01) |
| ***E04B 1/19*** | (2006.01) |
| ***E04B 1/35*** | (2006.01) |
| ***E04H 3/00*** | (2006.01) |
| ***E04B 1/343*** | (2006.01) |
| ***A63G 7/00*** | (2006.01) |
| ***A63G 31/10*** | (2006.01) |
| ***E04B 1/24*** | (2006.01) |
| ***E04B 1/348*** | (2006.01) |
| *B66B 9/00* | (2006.01) |
| *E04B 1/20* | (2006.01) |
| *A63G 21/04* | (2006.01) |

(52) U.S. Cl.

CPC ..... *A63G 2031/002* (2013.01); *B66B 9/00* (2013.01); *E04B 1/20* (2013.01); *E04B 1/2403* (2013.01); *E04B 1/3522* (2013.01); *E04B 2001/2484* (2013.01); *E04B 2001/3588* (2013.01); *E04B 2103/02* (2013.01); *E04B 2103/06* (2013.01)

(56) References Cited

U.S. PATENT DOCUMENTS 1,502,699 A 7/1924 Traubel
1,834,652 A 12/1931 Schmid
1,948,691 A 2/1934 Bauer
2,108,065 A 2/1938 Kotrbaty
2,172,838 A 9/1939 Flato
3,185,265 A 5/1965 White
3,331,168 A 7/1967 Frey
3,395,502 A 8/1968 Frey
3,517,774 A 6/1970 Meyer
3,605,354 A 9/1971 Hodgetts
1,988,075 A 4/1972 Fiorini
3,656,266 A 4/1972 Tylius
3,738,069 A 6/1973 Octaviano et al.
3,791,081 A 2/1974 Felciai
3,791,093 A 2/1974 Finsterwalder et al.
3,828,513 A 8/1974 Vanderklaauw
3,831,902 A 8/1974 Vanderklaauw
3,835,601 A 12/1974 Kelbish
3,863,418 A 2/1975 Faucheux
3,885,503 A 5/1975 Barber
3,894,367 A 7/1975 Yacoboni
3,895,473 A 7/1975 Fraser
3,921,362 A 11/1975 Corina
4,019,293 A 4/1977 Armas
4,028,792 A 6/1977 Tax
4,074,811 A 2/1978 Filak
4,136,492 A 1/1979 Willingham
4,143,703 A 3/1979 Creswick et al.
4,178,343 A 12/1979 Rojo, Jr.
4,272,050 A 6/1981 del Valle
4,301,630 A 11/1981 Burkland
4,555,877 A 12/1985 Libra
4,586,299 A 5/1986 Bayer
4,724,771 A 2/1988 Yamada
4,912,893 A 4/1990 Miller et al.
4,932,175 A 6/1990 Donnally
4,986,038 A 1/1991 Backer
5,056,668 A 10/1991 Berger
5,060,426 A 10/1991 Jantzen
5,105,589 A 4/1992 Rodriguez
5,127,491 A 7/1992 Just-Buddy
5,199,231 A 4/1993 Dever
5,203,744 A 4/1993 Checketts
5,247,776 A 9/1993 Tamayo
5,321,925 A 6/1994 Kaneko
5,392,877 A 2/1995 Shahin et al.
5,421,783 A 6/1995 Kockelman et al.
5,423,158 A 6/1995 Vora
5,450,695 A 9/1995 Desai
5,452,547 A 9/1995 Baloga et al.
5,490,364 A 2/1996 Desai et al.
5,528,866 A 6/1996 Yulkowski
5,573,465 A 11/1996 Kitchen et al.
5,628,690 A 5/1997 Spieldiener et al.
5,704,841 A 1/1998 Checketts
5,794,387 A 8/1998 Crookham
5,853,331 A 12/1998 Ishikawa et al.
6,083,111 A 7/2000 Moser et al.
6,250,426 B1 6/2001 Lombard
6,301,841 B1 10/2001 Rhebergen et al.
6,328,658 B1 * 12/2001 Gnezdilov ..... A63G 27/00 472/136
6,342,017 B1 1/2002 Kockelman
6,440,002 B1 8/2002 Jackson
6,523,647 B2 2/2003 Duplessis
6,569,024 B2 5/2003 Kleimeyer
6,615,542 B2 9/2003 Ware
6,650,934 B2 11/2003 Edwards
6,941,872 B2 9/2005 Roodenburg et al.
7,165,362 B2 1/2007 Jobs et al.
7,337,738 B2 3/2008 Hu
7,392,624 B2 7/2008 Kinzer
7,666,103 B2 2/2010 Pondorfer et al.
7,766,754 B2 * 8/2010 Davison, Jr. ..... G09F 19/22 40/427
8,011,098 B2 9/2011 Vorhies et al.
8,141,495 B2 3/2012 Baker et al.
8,240,051 B2 8/2012 Redock et al.
8,353,132 B1 1/2013 Vogt et al.
8,353,141 B2 1/2013 Berg
8,402,706 B2 3/2013 Fernandez Fernandez
8,490,549 B2 7/2013 Kitchen
8,491,403 B2 7/2013 Schreibfeder
8,646,240 B1 2/2014 Patrick et al.
8,690,694 B2 4/2014 Barber
8,926,440 B2 1/2015 Jacobi
9,181,694 B1 11/2015 Munoz
9,458,619 B2 10/2016 Bowron et al.
9,493,940 B2 11/2016 Collins et al.
9,556,636 B2 1/2017 Zavitz
9,695,585 B1 7/2017 Seiford, Sr.
9,744,469 B2 8/2017 Kitchen
9,925,469 B2 3/2018 Rupp
2002/0103033 A1 8/2002 Stengel
2002/0170784 A1 11/2002 Duplessis
2003/0172599 A1 9/2003 Frink
2004/0211126 A1 10/2004 Allen
2004/0231553 A1 11/2004 Distelrath et al.
2005/0098056 A1 5/2005 Roodenburg et al.
2005/0138867 A1 6/2005 Zhao
2006/0137563 A1 * 6/2006 Cummins ..... A63G 7/00 104/53
2006/0277843 A1 12/2006 Livingston et al.
2007/0010339 A1 1/2007 Stone
2007/0240622 A1 10/2007 Hu
2007/0264103 A1 11/2007 Shelton et al.
2007/0265103 A1 * 11/2007 Roodenburg ..... A63G 31/02 472/43
2009/0049762 A1 2/2009 Termohlen
2009/0193732 A1 8/2009 Clark et al.
2009/0320712 A1 12/2009 MacMahon et al.
2010/0193247 A1 8/2010 Riddle et al.
2010/0242406 A1 9/2010 Oliphant et al.
2010/0281818 A1 11/2010 Southworth
2010/0326734 A1 12/2010 Wasterval
2011/0219712 A1 9/2011 Clark et al.
2012/0304588 A1 12/2012 Von Ahn
2013/0092043 A1 4/2013 Kitchen
2013/0260906 A1 10/2013 Checketts
2013/0305632 A1 11/2013 Rivera, Sr. et al.
2014/0250806 A1 9/2014 Schibsbye
2014/0260076 A1 9/2014 Yustus et al.
2015/0141161 A1 5/2015 Alfieri et al.
2015/0267364 A1 9/2015 Cooper
2015/0292263 A1 10/2015 Hierl
2016/0032594 A1 2/2016 Lovell et al.
2016/0032601 A1 2/2016 McCaffrey
2016/0130832 A1 5/2016 Zavitz

(56) References Cited

U.S. PATENT DOCUMENTS

| | | | |
|---|---|---|---|
| 2016/0194896 | A1 | 7/2016 | Pondorfer |
| 2016/0215520 | A1 | 7/2016 | Samuelson |
| 2016/0258421 | A1 | 9/2016 | Agassi |
| 2016/0361660 | A1 | 12/2016 | Hreniuk-Mitchell |
| 2017/0044791 | A1 | 2/2017 | Farach et al. |
| 2017/0254105 | A1 | 9/2017 | Seiford, Sr. |

FOREIGN PATENT DOCUMENTS

| | | | |
|---|---|---|---|
| FR | 2315577 | A1 | 1/1977 |
| GB | 2365886 | | 2/2002 |
| JP | 2000160688 | A | 6/2000 |
| WO | 9118161 | A1 | 11/1991 |
| WO | 9219325 | | 11/1992 |
| WO | 9910063 | | 3/1999 |
| WO | 9960230 | | 11/1999 |
| WO | 20070048863 | A1 | 3/2007 |

OTHER PUBLICATIONS

NBC News 6. Planned 1000-Foot Miami Tourist Tower Sparks Politics Scrum, Apr. 22, 2015 (Apr. 22, 2015) [retrieved on Oct. 31, 2017]. Retrieved from th internet. <URL: https://www.nbcmiami.com/news/local/Planned-1000-Foot-Miami-Tourist-Tower-Sparks-Politics-Scrum-300956091.html>entire document.

International Search Report and Written Opinion issued in counterpart International Application Serial No. PCT/US2017/052794 dated Nov. 28, 2017.

International Search Report and Written Opinion issued in counterpart International Application Serial No. PCT/US2017/052795 dated Dec. 5, 2017.

SkyRise Miami Intro' Multivision Video & Film (vimeo.com) Sep. 14, 2014 (Sep. 14, 2014) (video)<URL:https://vimeo.com/106104999> entire document, especially pp. 1-12 pdf.

International Search Report and Written Opinion issued in counterpart International Application Serial No. PCT/US2017/052750, dated Dec. 14, 2017.

International Search Report and Written Opinion issued in counterpart International Application Serial No. PCT/US2017/052786, dated Dec. 14, 2017.

IDLift 3000. Amazing Mitsubishi Exterior Observation Elevators at Pan Pacific Singapore. YouTube (https://www.youtube.com/). Dec. 24, 2015. Retrieved from internet: Nov. 22, 2017. https://www.youtube.com/watch?v=yfGG4bGwhik.

International Search Report and Written Opinion issued in counterpart International Application Serial No. PCT/US2017/052782, dated Dec. 14, 2017.

International Search Report and Written Opinion issued in counterpart International Application Serial No. PCT/US2017/052768, dated Dec. 15, 2017.

International Search Report and Written Opinion issued in counterpart International Application Serial No. PCT/US2017/052755, dated Dec. 14, 2017.

International Search Report and Written Opinion issued in counterpart International Application Serial No. PCT/US2017/052733, dated Dec. 14, 2017.

International Search Report and Written Opinion issued in counterpart International Application Serial No. PCT/US2017/052735, dated Dec. 14, 2017.

International Search Report and Written Opinion issued in counterpart International Application Serial No. PCT/US2017/052785, dated Dec. 14, 2017.

International Search Report and Written Opinion issued in counterpart International Application Serial No. PCT/US2017/052712, dated Dec. 14, 2017.

Non-Final Office Action issued in counterpart U.S. Appl. No. 15/711,454 dated Apr. 4, 2018.

Non-Final Office Action issued in counterpart U.S. Appl. No. 15/711,231 dated Mar. 28, 2018.

Non-Final Office Action issued in counterpart U.S. Appl. No. 15/711,322 dated Mar. 22, 2018.

Non-Final Office Action issued in counterpart U.S. Appl. No. 15/711,514 dated Apr. 4, 2018.

Design Examination Report No. 1 issued in counterpart Australian Design Patent Application No. 201812664 dated Jun. 10, 2018.

Design Examination Report No. 1 issued in counterpart Australian Design Patent Application No. 201811053 dated Jun. 10, 2018.

Non-Final Office Action issued in U.S. Appl. No. 15/711,324 dated Jun. 22, 2018.

Non-Final Office Action issued in U.S. Appl. No. 15/711,574 dated Jul. 10, 2018.

Non-Final Office Action issued in U.S. Appl. No. 15/711,148 dated Jul. 27, 2018.

Non-Final Office Action issued in U.S. Appl. No. 15/711,224 dated Jul. 31, 2018.

The "Building" which was published on the website https://www.trendhunter.com/trends/the-solar-universe on Jun. 7, 2011.

The "Building" which was published on the website https://johnseidel.com/skyrise-miami/on Feb. 28, 2014.

The "Building" which was published on the website https://www.youtube.com/watch?v+G47-de5jRKE on Sep. 30, 2014.

The "Building" which was published on the website https://www.facebook.com/SkyRisemiami/on Mar. 1, 2016.

Final Office Action issued in U.S. Appl. No. 15/711,231 dated Oct. 31, 2018.

Final Office Action issued in U.S. Appl. No. 15/711,514 dated Nov. 2, 2018.

Non-Final Office Action issued in U.S. Appl. No. 15/711,372 dated Dec. 20, 2018.

Final Office Action issued in U.S. Appl. No. 15/711,322 dated Jan. 7, 2019.

Final Office Action issued in U.S. Appl. No. 15/711,454 dated Jan. 11, 2019.

Non-Final Office Action issued in U.S. Appl. No. 15/711,602 dated Apr. 1, 2019.

Final Office Action issued in U.S. Appl. No. 15/711,324 dated Apr. 10, 2019.

Final Office Action issued in U.S. Appl. No. 15/711,574 dated Apr. 12, 2019.

Notice of Allowance issued in U.S. Appl. No. 15/711,148 dated Apr. 12, 2019.

Final Office Action issued in U.S. Appl. No. 15/711,224 dated Apr. 25, 2019.

Non-Final Office Action issued in U.S. Appl. No. 15/711,224 dated Nov. 25, 2019.

* cited by examiner

250

300

300

100

STRUCTURE AND METHOD OF MAKING THE SAME

RELATED APPLICATION(S)

This application claims the benefit of U.S. Provisional Application No. 62/397,681, filed on 21 Sep. 2016; the contents of which are incorporated herein by reference.

TECHNICAL FIELD

This disclosure relates to structures and, more particularly, to entertainment structures and methods of making the same.

BACKGROUND

Throughout the years, the manner in which buildings and structures have been constructed has greatly changed. For example, prior to the use of structural steel within buildings/structures, buildings/structures were constructed out of some form of stone, which prevented such buildings/structures from achieving substantial height, as the lower walls of the building/structure would need to be prohibitively thick in order to bear the weight of the upper portion of the building/structure.

However, as the design of buildings/structures changed and advanced throughout the years, buildings/structures unimaginable at one time are now highly achievable. For example, the use of structural steel has allowed very tall building/structures to be constructed, wherein the steel frame provides the needed strength without the excessive weight of stone. Accordingly, tall buildings/structures may be built without overburdening the foundation and lower walls of the building/structure.

However, for pretty close the past 100 years, buildings/structures have been built in substantially the same fashion. Specifically, the foundation of the building is constructed, upon which the structural steel framework is attached, to which the floor plates and various exterior panels that form the outside of the building are attached.

Unfortunately, the continued use of such traditional building techniques often prevents the advancement of modern building design.

SUMMARY OF DISCLOSURE

In ne implementation, an vertical entertainment structure includes: an offset core; a moment stabilizing structure; a plurality of floor plate assemblies; and two or more entertainment rides that each span at least two of the plurality of floor plate assemblies.

One or more of the following features may be included. The plurality of floor plate assemblies may each include: a first edge; and a second edge. The first edge of each of the plurality of floor plate assemblies may be configured to be coupled to the offset core and the second edge of each of the plurality of floor plate assemblies may be configured to be coupled to the moment stabilizing structure. The moment stabilizing structure may include: a truss assembly; and a floor tying assembly. The truss assembly may include at least one essentially diagonal brace assembly. The floor tying assembly may be configured to index the plurality of floor plate assemblies with respect to each other and transfer the load of the plurality of floor plate assemblies to the truss assembly. The first edge of the plurality of floor plate assemblies may be essentially opposite to the second edge of the plurality of floor plate assemblies. The offset core may be a concrete offset core. The concrete offset core may be a slip-formed concrete offset core. The offset core may be configured to include one or more of: one or more elevator assemblies; one or more ventilation assemblies; and one or more stair assemblies. The offset core may be positioned proximate the periphery of the vertical entertainment structure. At least one of the plurality of floor plate assemblies positioned toward the top of the entertainment structure may be larger than at least one of the plurality of floor plate assemblies positioned toward the bottom of the entertainment structure. The two or more entertainment rides may include one or more of: a moveable, observation pod entertainment ride positioned outside of the vertical entertainment structure; a tethered, freefall entertainment ride positioned within the vertical entertainment structure; a track-based, freefall entertainment ride positioned outside of the vertical entertainment structure; and a transparent, observation platform entertainment ride positioned outside of the vertical entertainment structure.

In another implementation, an vertical entertainment structure includes: an offset core; a moment stabilizing structure; a plurality of floor plate assemblies; and two or more entertainment rides that each span at least two of the plurality of floor plate assemblies, wherein the two or more entertainment rides include one or more of: a moveable, observation pod entertainment ride positioned outside of the vertical entertainment structure; a tethered, freefall entertainment ride positioned within the vertical entertainment structure; a track-based, freefall entertainment ride positioned outside of the vertical entertainment structure; and a transparent, observation platform entertainment ride positioned outside of the vertical entertainment structure.

One or more of the following features may be included. The moment stabilizing structure may include: a truss assembly; and a floor tying assembly. The offset core may be configured to include one or more of: one or more elevator assemblies; one or more ventilation assemblies; and one or more stair assemblies. At least one of the plurality of floor plate assemblies positioned toward the top of the entertainment structure may be larger than at least one of the plurality of floor plate assemblies positioned toward the bottom of the entertainment structure.

In another implementation, a vertical entertainment structure includes: an offset core; a moment stabilizing structure; a plurality of floor plate assemblies, wherein each of the plurality of floor plate assemblies includes a first edge and a second edge. The first edge of each of the plurality of floor plate assemblies is configured to be coupled to the offset core and the second edge of each of the plurality of floor plate assemblies is configured to be coupled to the moment stabilizing structure. Two or more entertainment rides each span at least two of the plurality of floor plate assemblies. The two or more entertainment rides include one or more of: a moveable, observation pod entertainment ride positioned outside of the vertical entertainment structure; a tethered, freefall entertainment ride positioned within the vertical entertainment structure; a track-based, freefall entertainment ride positioned outside of the vertical entertainment structure; and a transparent, observation platform entertainment ride positioned outside of the vertical entertainment structure. The moment stabilizing structure includes: a truss assembly; and a floor tying assembly.

One or more of the following features may be included. The truss assembly may include at least one essentially diagonal brace assembly. The floor tying assembly may be configured to index the plurality of floor plate assemblies with respect to each other and transfer the load of the plurality of floor plate assemblies to the truss assembly.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
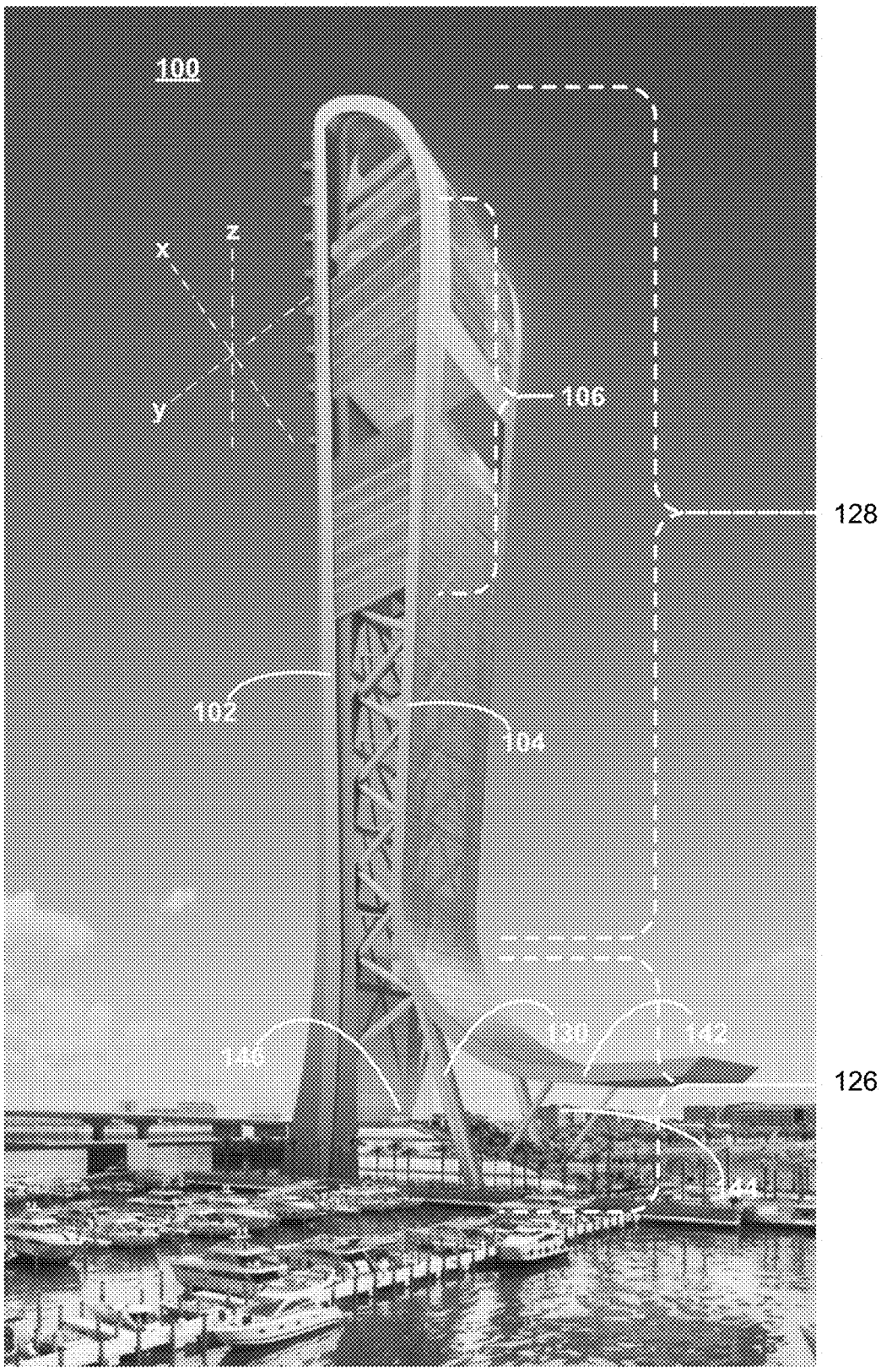
FIG. 1 is a perspective view of a structure.
Figure 2:
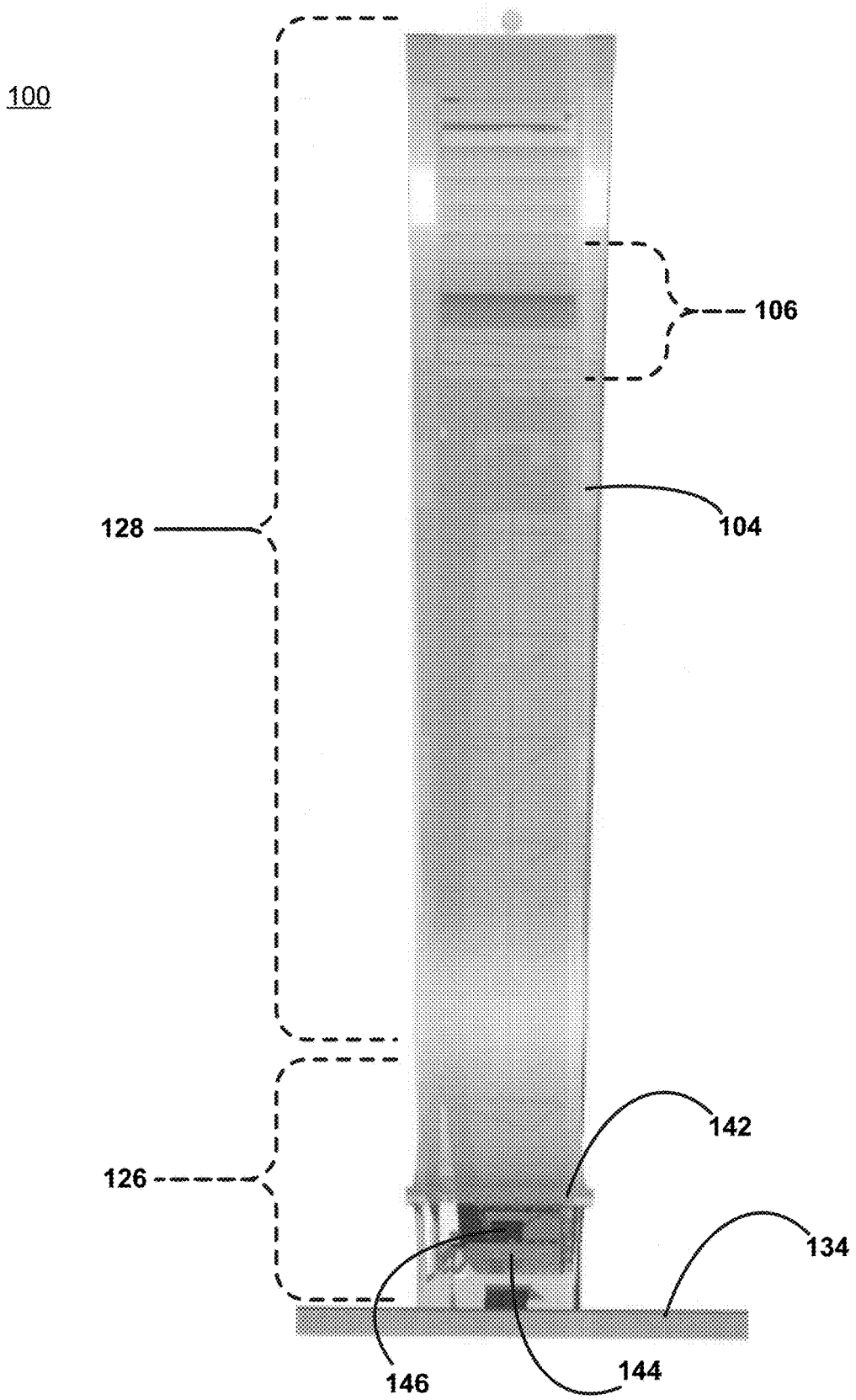
FIG. 2 is a front view of the structure of FIG. 1.
Figure 3:
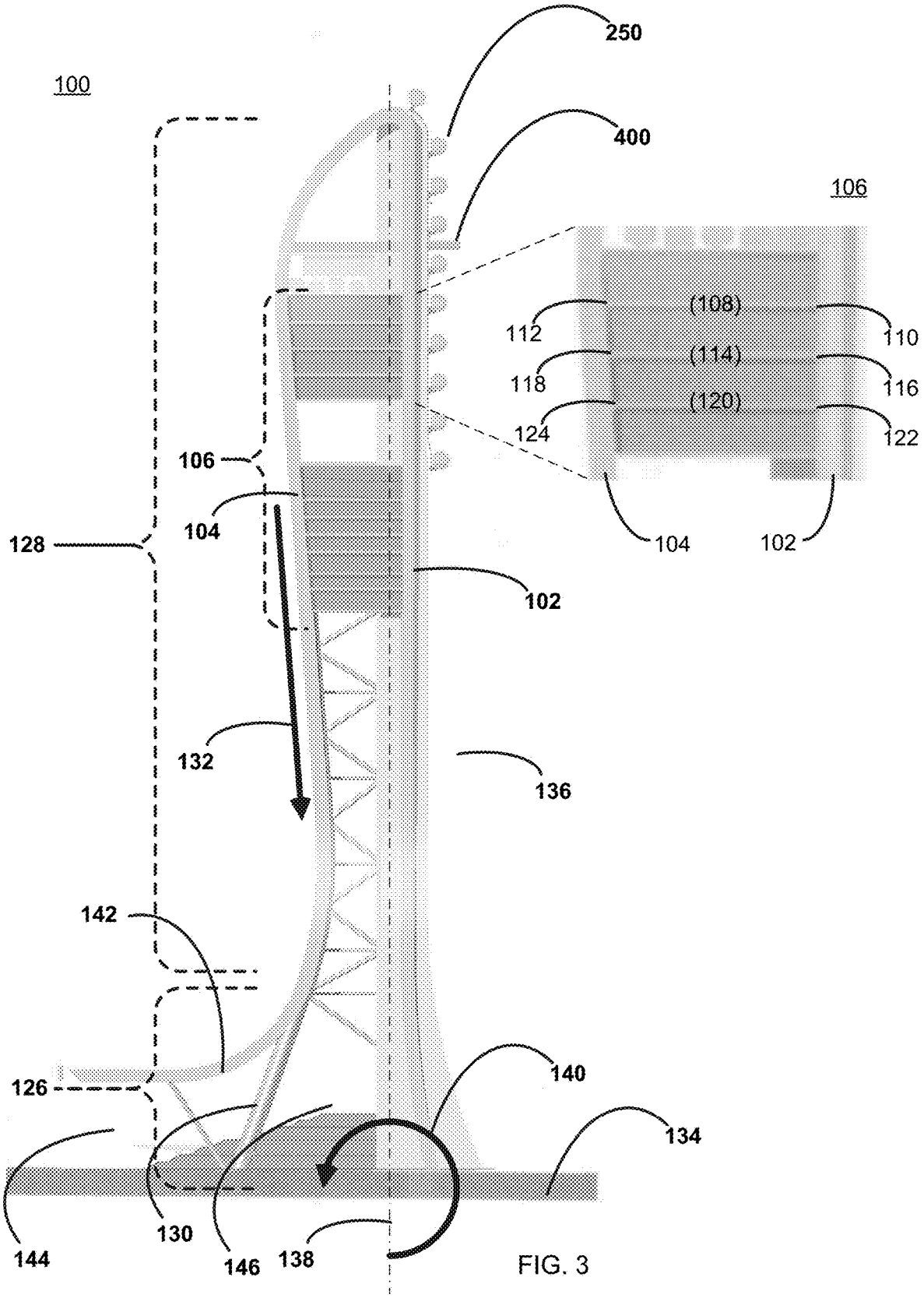
FIG. 3 is a right-side view of the structure of FIG. 1.
Figure 4:
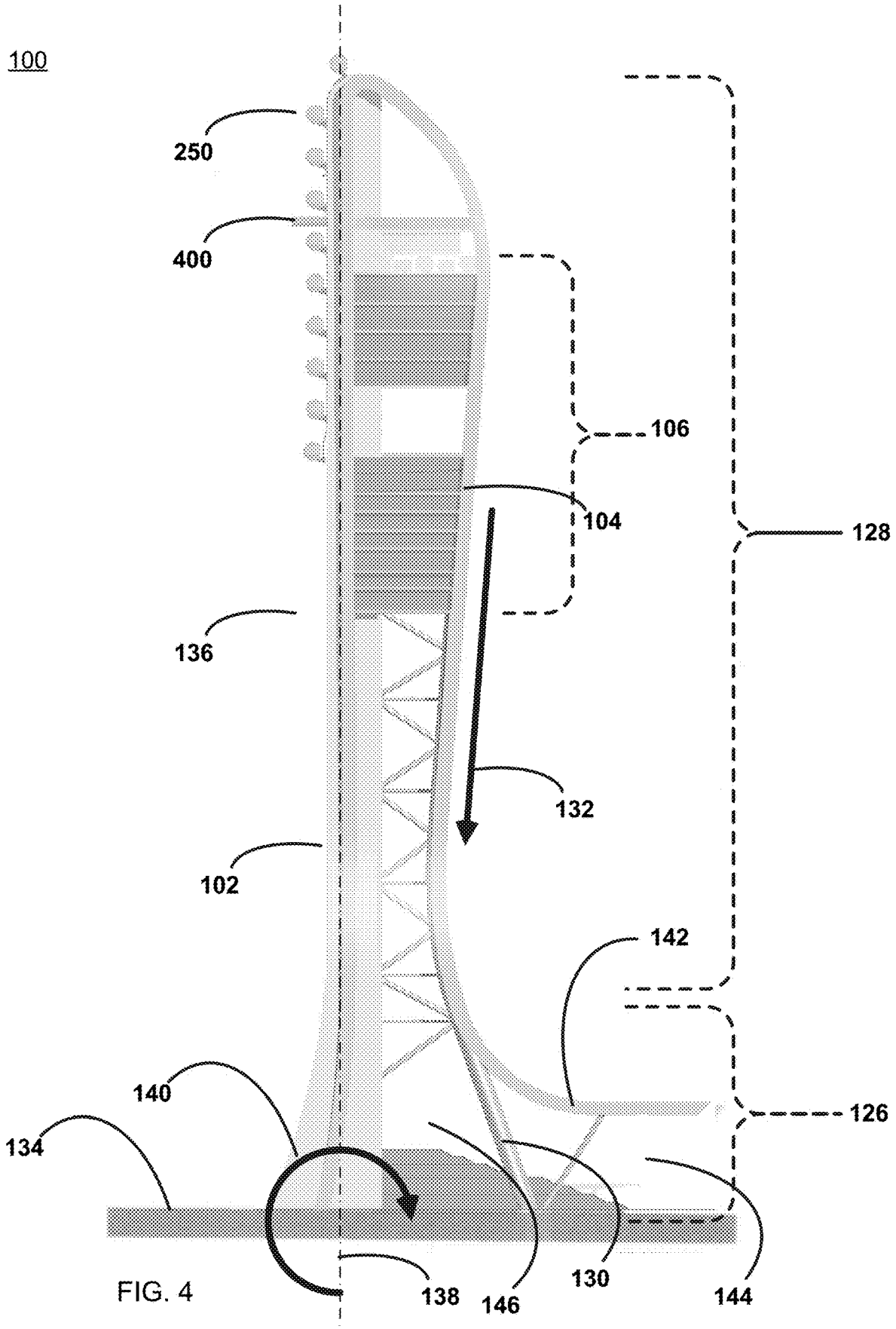
FIG. 4 is a left-side view of the structure of FIG. 1.
Figure 5:
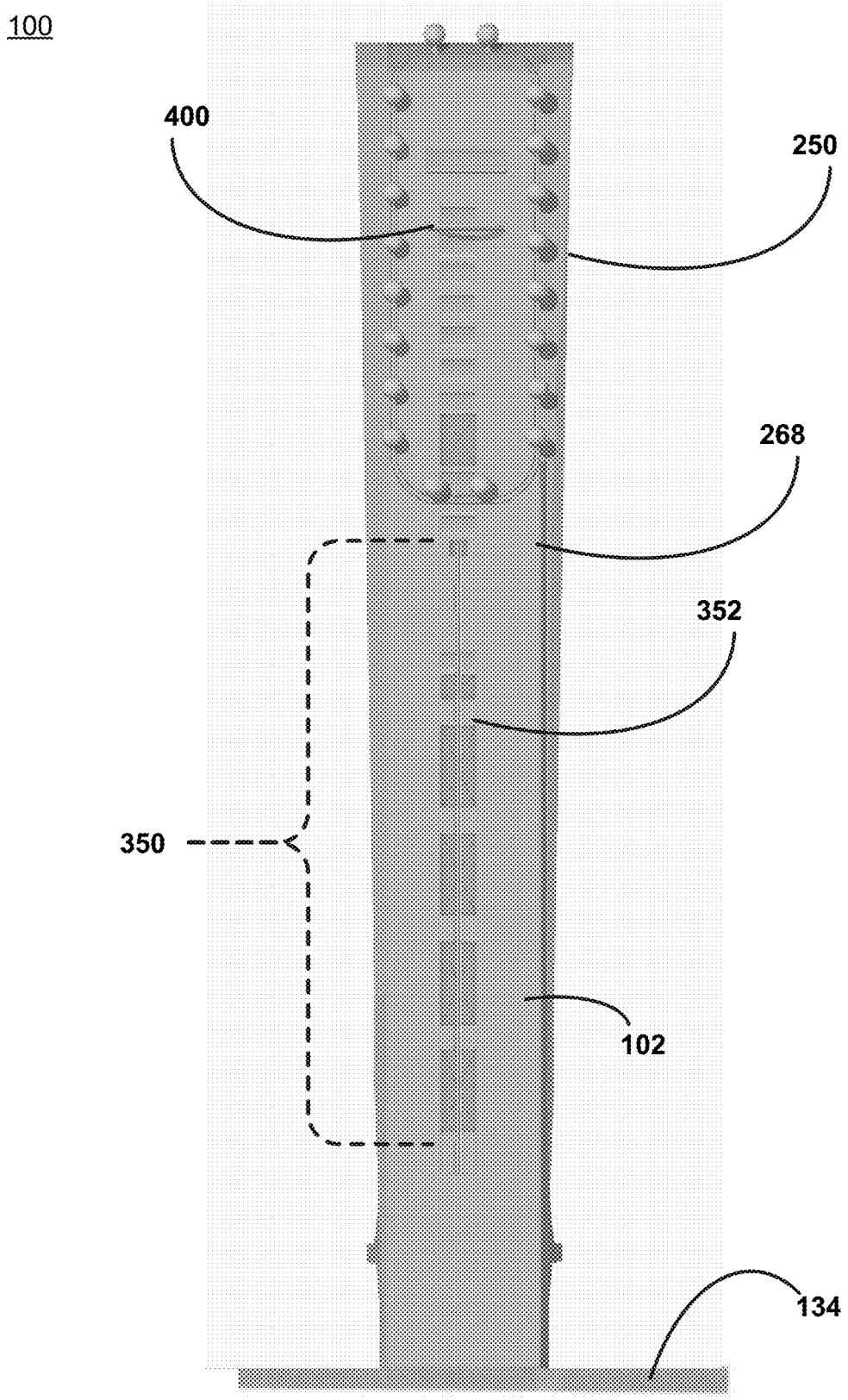
FIG. 5 is a back view of the structure of FIG. 1.

Referring to FIGS. 1-5, there is shown various views of structure 100. Specifically, FIG. 1 is a perspective view of structure 100, FIG. 2 is a front view of structure 100, FIG. 3 is a right-side view of structure 100, FIG. 4 is a left-side view of structure 100, and FIG. 5 is a back view of structure 100. Examples of structure 100 may include but is not limited to a residential building/structure, a office building/structure, a vertical entertainment building/structure, a tower structure, and an observation structure. Structure 100 may include offset core 102, moment stabilizing structure 104 and plurality of floor plate assemblies 106.

Offset core 102 may be a concrete offset core, wherein this concrete offset core may be a slip-formed concrete offset core. As is known in the art, slip forming (also known as continuous pouring and/or continuous forming) is a construction method in which concrete is poured into a continuously moving form.

Slip forming may be used for vertical structures (e.g., bridges, towers, buildings, dams), as well as for horizontal structures (e.g., roadways). Slip forming may enable continuous, non-interrupted, cast-in-place "flawless" (i.e. no joints) concrete structures that may provide superior performance characteristics when compared to piecewise construction using discrete form elements.

Slip forming may rely on the quick-setting properties of concrete and may require a balance between quick-setting capacity and workability. For example, the concrete used may need to be workable enough to be placed into the form and consolidated (via vibration), yet quick-setting enough to emerge from the form with strength. This strength may be needed because the freshly set concrete must not only permit the form to "slip" by the concrete without disturbing it, but also to support the pressure of the new concrete as well as resist collapse caused by the vibration of the compaction machinery.

When using slip forming on vertical structures, the concrete form may be surrounded by a platform on which workers may stand. Together, the concrete form and the working platform may be raised by e.g., hydraulic jacks. Generally, the slipform may be raised at a rate that permits the concrete to harden by the time it emerges from the bottom of the form.

Moment stabilizing structure 104 may be constructed of structural steel and may be configured to provide the appropriate aesthetic value. For example, moment stabilizing structure 104 may be constructed out of tubular structural steel sized in accordance with the load that would be experienced by moment stabilizing structure 104. In one particular implantation, portions of moment stabilizing structure 104 may be up to 16' in diameter and may be constructed of 3" thick mild steel. To further enhance strength, some or all of moment stabilizing structure 104 may be filed with concrete.

Each of plurality of floor plate assemblies 106 may include a first edge and a second edge. For example, floor plate assembly 108 within plurality of floor plate assemblies 106 is shown to include first edge 110 and second edge 112; floor plate assembly 114 within plurality of floor plate assemblies 106 is shown to include first edge 116 and second edge 118; and floor plate assembly 120 within plurality of floor plate assemblies 106 is shown to include first edge 122 and second edge 124.

The first edge (e.g., first edges 110, 116, 122) of plurality of floor plate assemblies 106 may be essentially opposite to the second edge (e.g., second edges 112, 118, 124) of plurality of floor plate assemblies 106.

The first edge (e.g., first edges 110, 116, 122) of each of plurality of floor plate assemblies 106 may be configured to be coupled to offset core 102 and the second edge (e.g., second edges 112, 118, 124) of each of plurality of floor plate assemblies 106 may be configured to be coupled to moment stabilizing structure 104. For example, the first edge (e.g., first edges 110, 116, 122) of each of plurality of floor plate assemblies 106 may be e.g., bolted to and/or welded to e.g., one or more embedded steel plates included within/cast into offset core 102. Further, the second edge (e.g., second edges 112, 118, 124) of each of plurality of floor plate assemblies 106 may be bolted to and/or welded to e.g., moment stabilizing structure 104.

Moment stabilizing structure 104 may include truss assembly 126 and floor tying assembly 128, wherein truss assembly 126 may includes at least one essentially diagonal brace assembly (e.g., essentially diagonal brace assembly 130).

Floor tying assembly 128 may be configured to index plurality of floor plate assemblies 106 with respect to each other (e.g., thus providing the appropriate spacing between floor plate assemblies 108, 114, 120). Additionally, floor tying assembly 128 may be configured to transfer the load (e.g., load 132) of plurality of floor plate assemblies 106 to truss assembly 126. Specifically, load 132 may be transferred through essentially diagonal brace assembly 130 to grade/foundation/footing 134.

Offset core 102 may be positioned proximate the periphery 136 of structure 100. For example, offset core 102 is shown to form the back wall of structure 100, wherein (and as discussed above) the first edge (e.g., first edges 110, 116, 122) of each of plurality of floor plate assemblies 106 may be configured to be coupled to offset core 102. Accordingly, plurality of floor plate assemblies 106 may be off center with respect to centerline 138 of offset core 106, resulting in the creation of moment 140 about the base of offset core 102. Accordingly and through the use of truss assembly 126 (and essentially diagonal brace assembly 130), moment 140 may be effectively cancelled.

At least one of plurality of floor plate assemblies 106 positioned toward the top of structure 100 may be larger than at least one of plurality of floor plate assemblies 106 positioned toward the bottom of structure 100. For example, floor plate assembly 108 is shown to be larger (in the y-axis) than floor plate assembly 114; wherein floor plate assembly 114 is shown to be larger (in the y-axis) than floor plate assembly 120.

Accordingly and through the use of a system that employs offset core 102 and moment stabilizing structure 104, structures (e.g., structure 100) may be created that have widths and/or depths that are larger than the footprint of the structure itself. Further and through the use of a system that employs offset core 102 and moment stabilizing structure 104 (to effectively cancel moment 140), structures (e.g., structure 100) may be constructed that are asymmetrical in nature, as the various floor plate assemblies (e.g., floor plate assembly 108, 114, 120) need not be centered about offset core, as any moment about the base of offset core 104 may be effectively cancelled by moment stabilizing structure 104 (generally) and truss assembly 126 and/or essentially diagonal brace assembly 130 (specifically).

A canopy assembly (e.g., canopy assembly 142) may be coupled to moment stabilizing structure 104 and may be configured to form an atrium (e.g., atrium 144) proximate the entryway (e.g., entryway 146) of structure 100. In certain configuration, canopy assembly 142 may be purely aesthetic in nature. In other configurations, canopy assembly 142 may be constructed from various different materials (e.g., metal, wood, plastic and/or glass) and may be configured to shield visitors of structure 100 from rain, snow, wind and/or sunshine.

Figure 6:
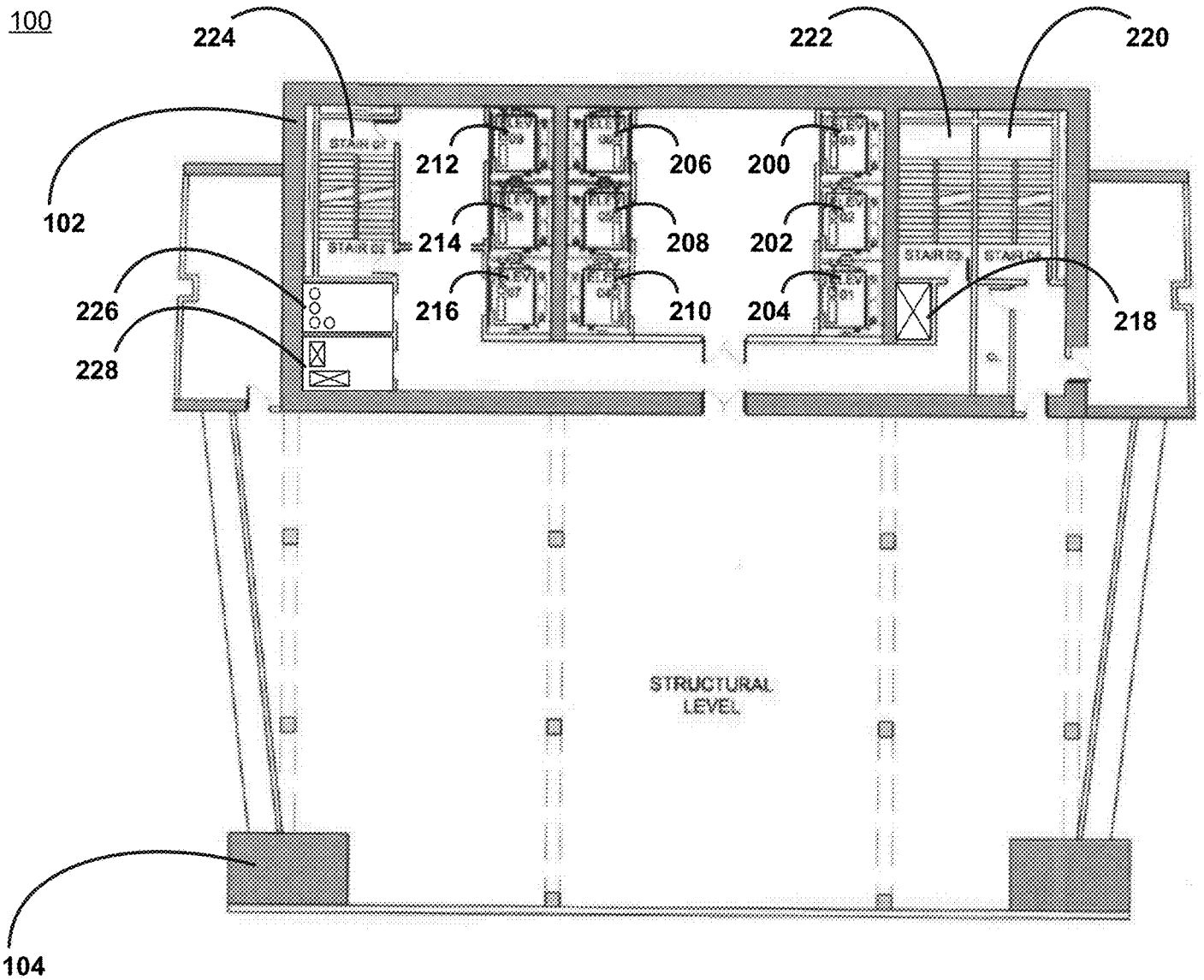
FIG. 6 is a cross-sectional view of the structure of FIG. 1.

As is standard in the construction trades, offset core 102 may be configured to house various systems and subsystems. Referring also to FIG. 6, there is shown a cross-sectional view of structure 100, wherein examples of such systems and subsystems may include but are not limited to one or more elevator assemblies (e.g., elevator assemblies 200, 202, 204, 206, 208, 210, 212, 214, 216), one or more ventilation assemblies (e.g., ventilation assembly 218), one or more stair assemblies (e.g., stair assemblies 220, 222, 224), one or more plumbing systems (e.g., standpipes 226) and one or more electrical systems (e.g., electrical systems 228).

As discussed above, an example of structure 100 may include but is not limited to a vertical entertainment building/structure and, when configured in such a manner, structure 100 may be configured to include entertainment rides that may each be multi-story entertainment rides (e.g., entertainment rides that span at least two of plurality of floor plate assemblies 106). As will be discussed below in greater detail, examples of such entertainment rides may include but are not limited to: a) moveable, observation pod entertainment ride 250 (see FIGS. 7A-7B) positioned outside of structure 100; b) tethered, freefall entertainment ride 300 (see FIG. 8A-8B) positioned within structure 100; c) track-based, freefall entertainment ride 350 (see FIG. 9A-9B) positioned outside of structure 100; and transparent, observation platform entertainment ride 400 (see FIG. 10) positioned outside of structure 100.

Figure 7A:
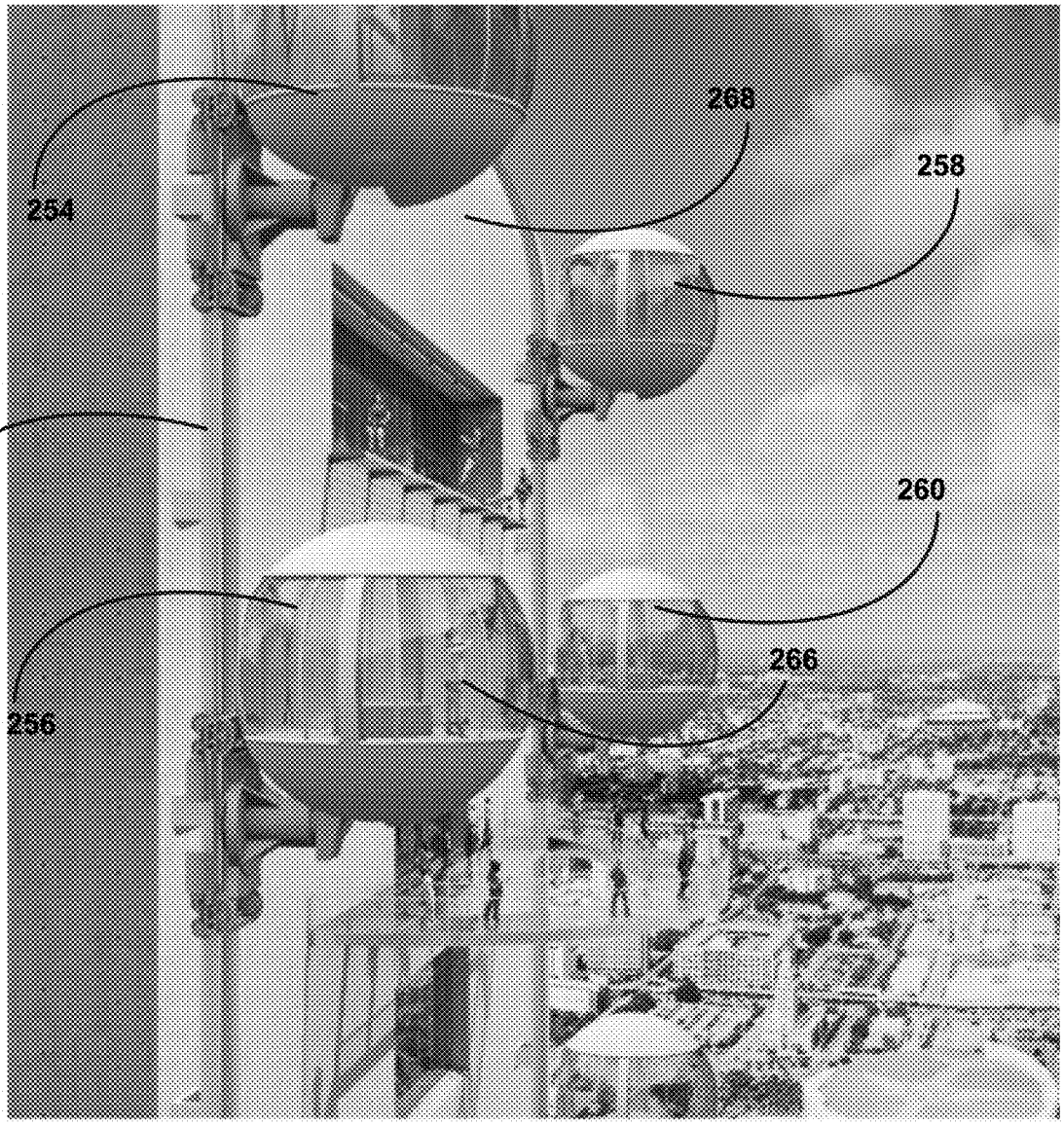
FIGS. 7A-7B are diagrammatic views of a first exemplary entertainment ride incorporated into the structure of FIG. 1.
Figure 7B:
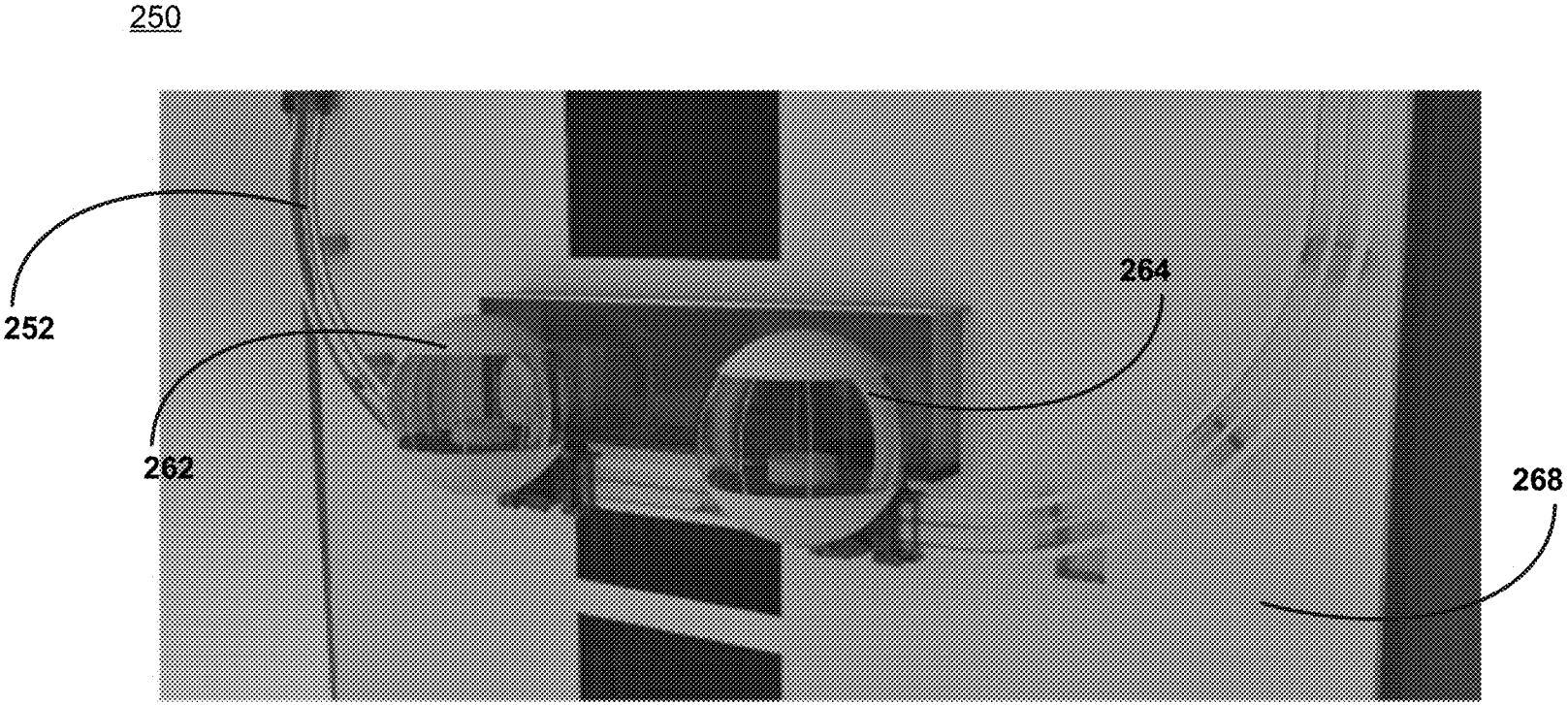

Referring also to FIG. 7A-7B, moveable, observation pod entertainment ride 250 positioned outside of structure 100 may include track assembly 252 and at least one observation pod (e.g., observation pods 254, 256, 258, 260, 262, 264) configured to contain one or more riders (e.g., rider 266) and configured to be moveable along track assembly 252. Moveable, observation pod entertainment ride 250 may be positioned proximate an outside portion (e.g., outside portion 268) of offset core 102. Observation pods 254, 256, 258, 260, 262, 264 may be configured to auto-level so that they remain level while moving along track assembly 252.

Figure 8A:
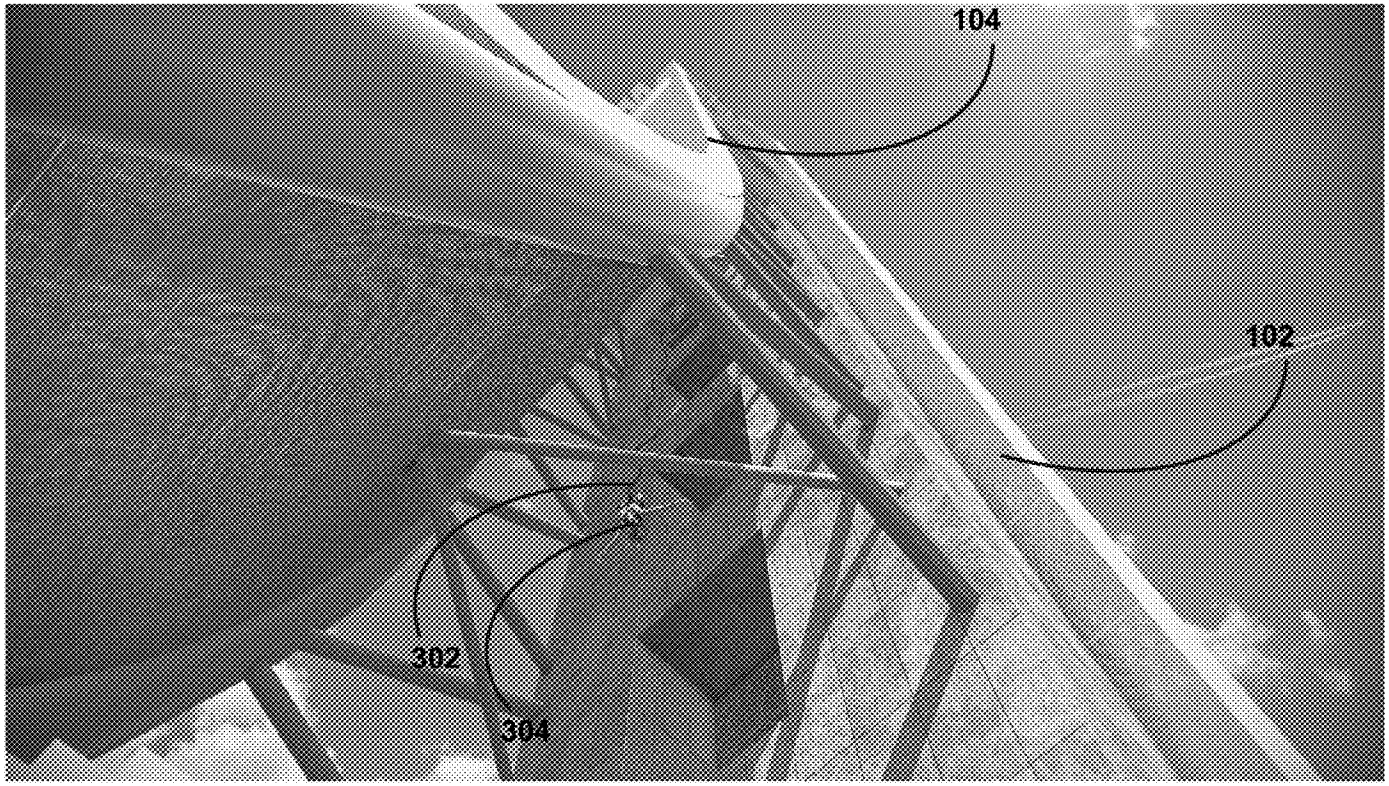
FIGS. 8A-8B are diagrammatic views of a second exemplary entertainment ride incorporated into the structure of FIG. 1.
Figure 8B:
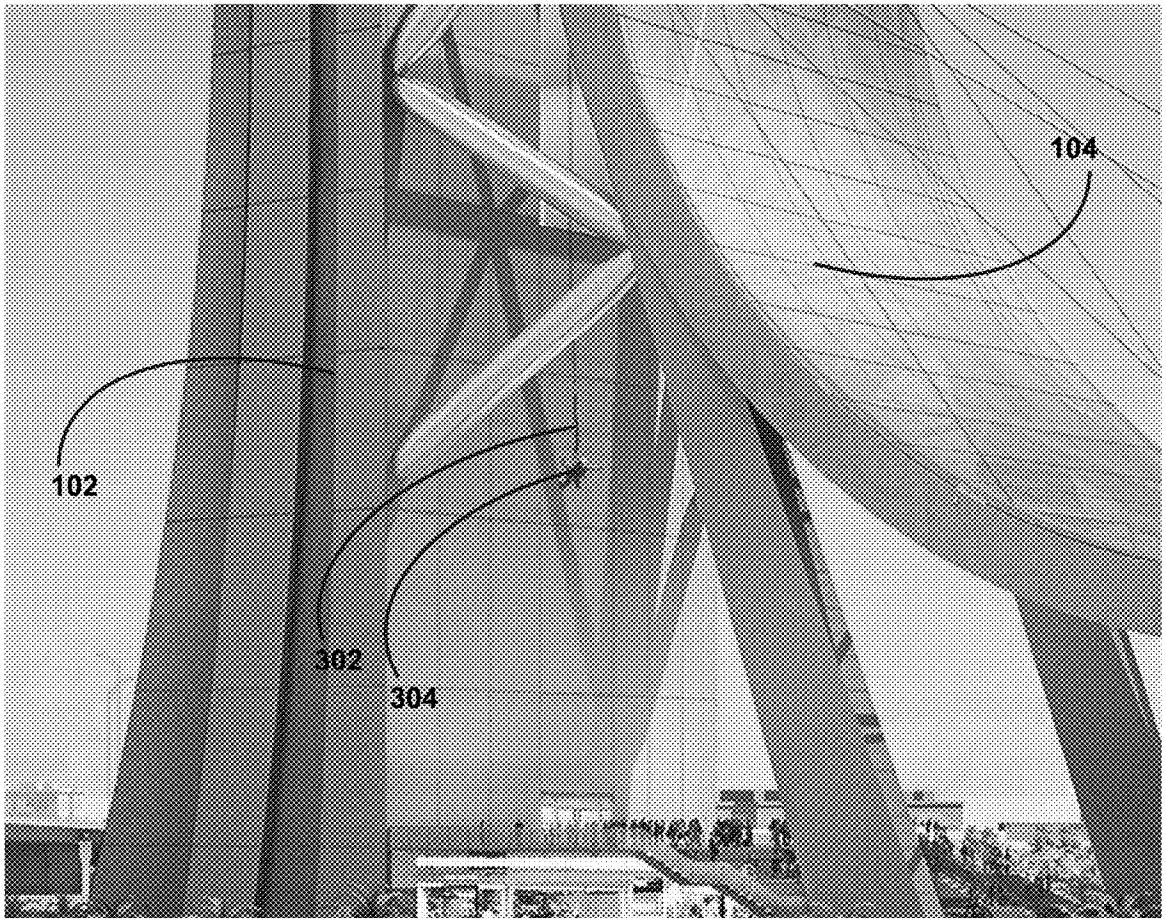

Referring also to FIGS. 8A-8B, tethered, freefall entertainment ride 300 positioned within structure 100 may include bungee assembly 302 coupled on a first end to an upper portion of structure 100, wherein bungee assembly 302 may be configured to be releasably coupled on a second end to a rider (e.g., rider 304). Tethered, freefall entertainment ride 300 may be positioned between offset core 102 and moment stabilizing structure 104. Accordingly and when using tethered, freefall entertainment ride 300, rider 304 may travel up to a higher portion of structure 100 (via offset core 102) and may be attached to bungee assembly 302 (typically via a body harness worn by rider 304). Tethered, freefall entertainment ride 300 may include one or more control cables and/or guide cables (not shown), thus maintaining rider 304 in the center of the space formed between offset core 102 and moment stabilizing structure 104. Rider 304 may then freefall from this higher portion of structure 100 downward between offset core 102 and moment stabilizing structure 104 until bungee assembly 302 slows and eventually stops the descent of rider 304 at a distance sufficiently above grade to ensure proper and safe operation of tethered, freefall entertainment ride 300.

Figure 9A:
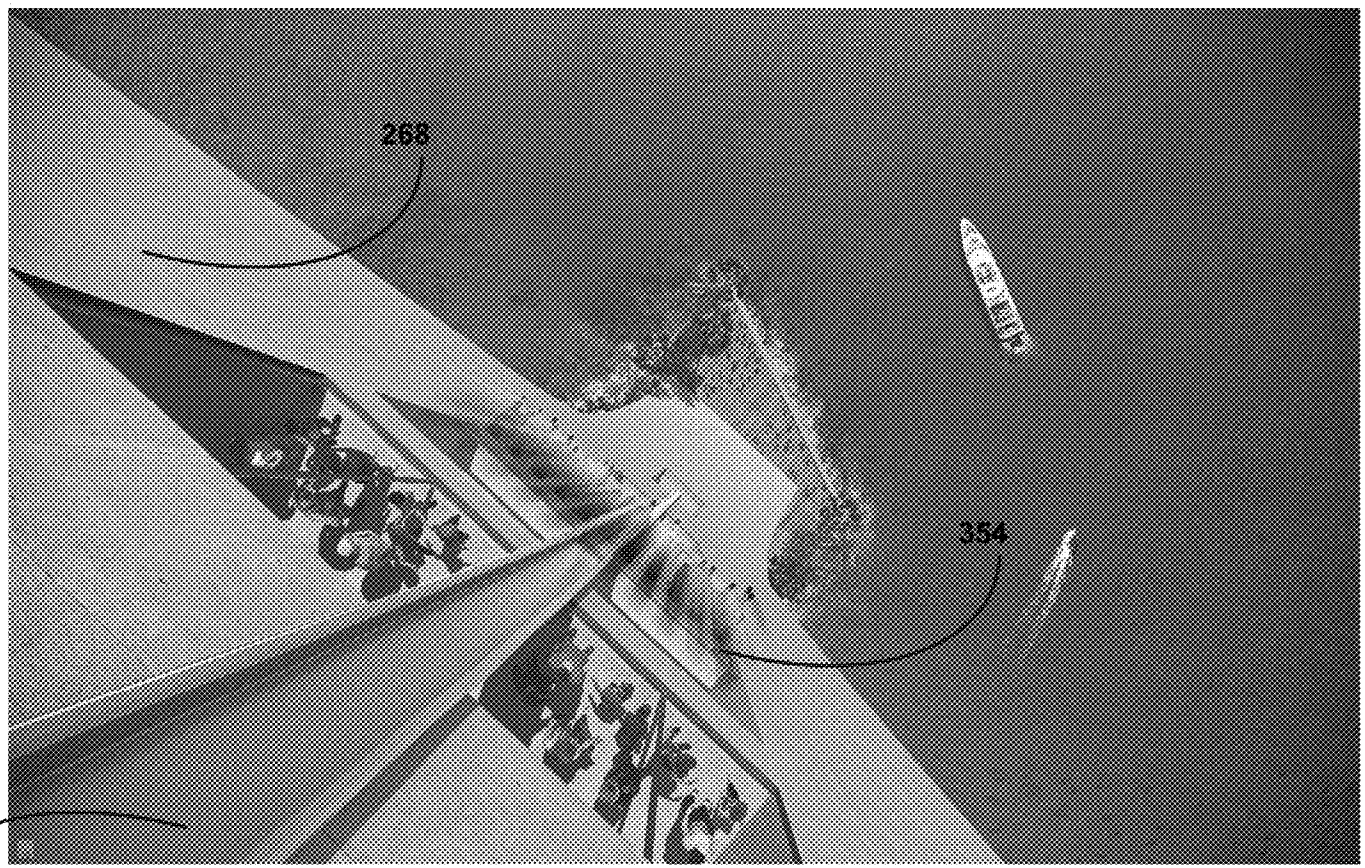
FIGS. 9A-9B are diagrammatic views of a third exemplary entertainment ride incorporated into the structure of FIG. 1.
Figure 9B:
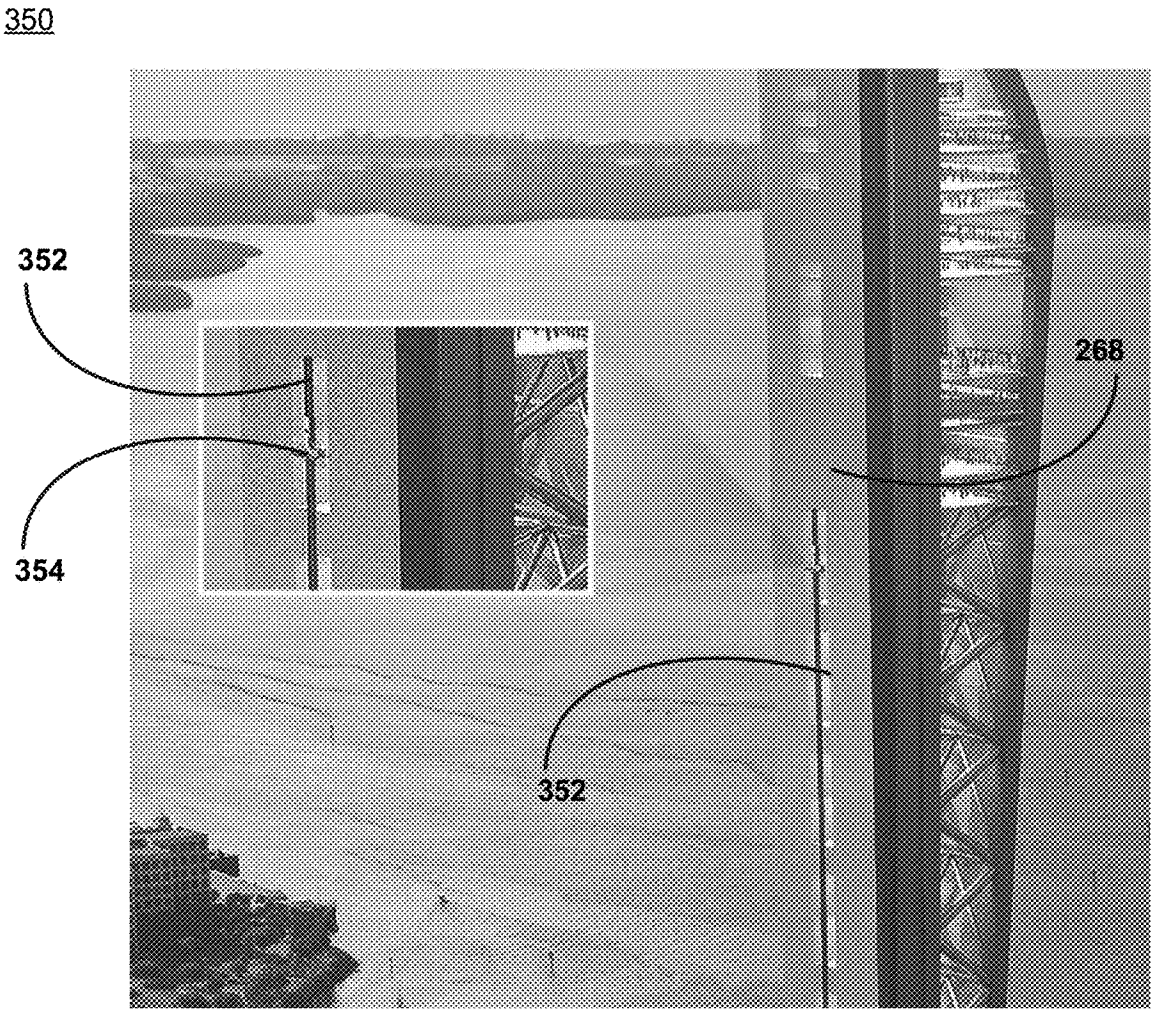

Referring also to FIGS. 9A-9B, track-based, freefall entertainment ride 350 positioned outside of structure 100 may include an essentially vertical track assembly 352 and vehicle assembly 354 configured to contain one or more riders (not shown) and configured to be moveable along essentially vertical track assembly 352. Track-based, freefall entertainment ride 350 may be positioned proximate an outside portion (e.g., outside portion 268) of offset core 102. Accordingly and when using track-based, freefall entertainment ride 350, a rider (not shown) may enter (and be secured within) vehicle assembly 354. Vehicle assembly 354 may then be lifted (via one or more cables, not shown) to a higher portion of structure 100. Vehicle assembly 354 may then freefall from this higher portion of structure 100 downward along vertical track assembly 352 until vehicle assembly 354 slows and eventually stops its descent toward the bottom of vertical track assembly 352 via one or more magnet assemblies (not shown) positioned proximate a lower portion of vertical track assembly 352.

Figure 10:
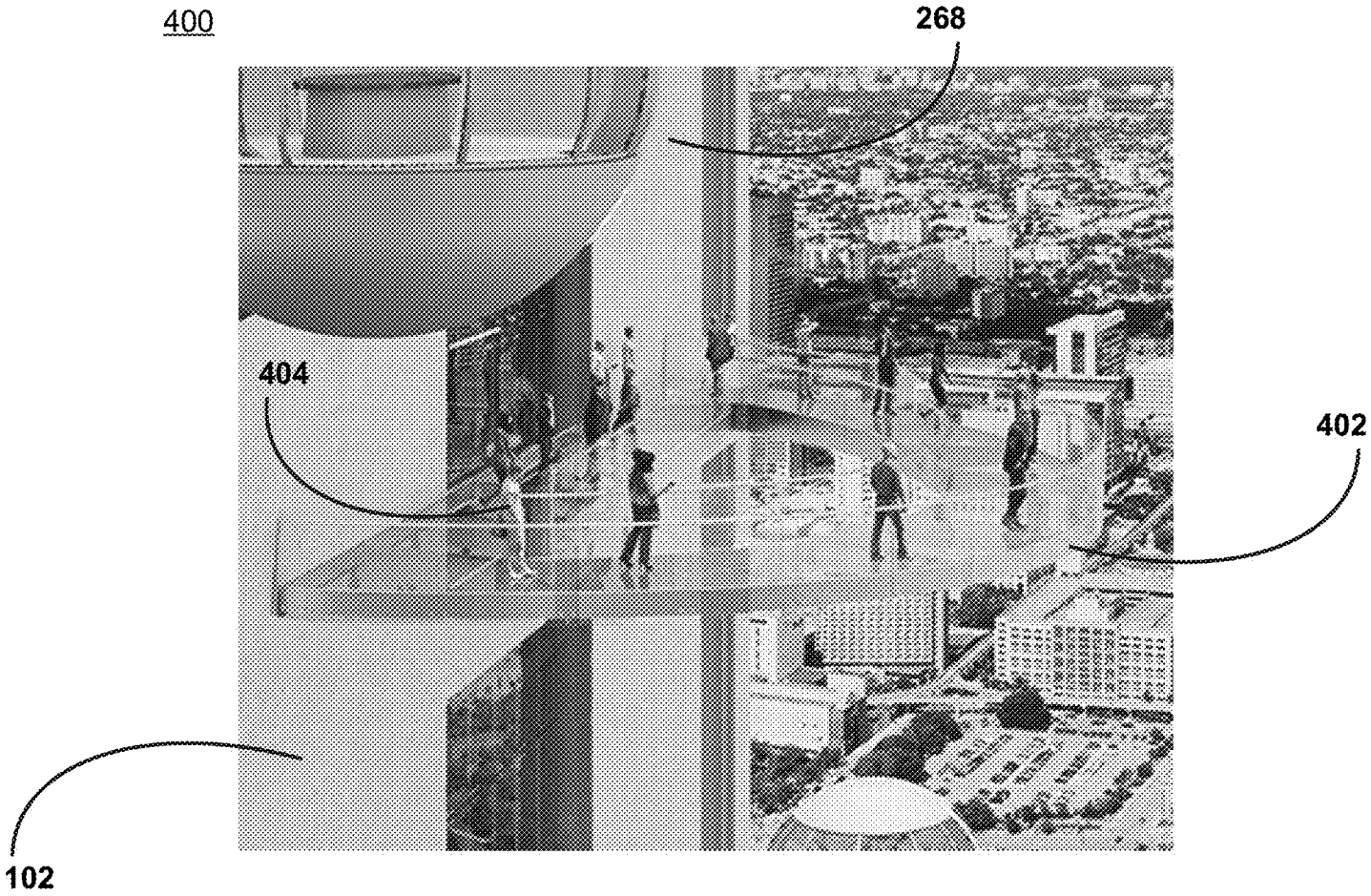
FIG. 10 is a diagrammatic view of a fourth exemplary entertainment ride incorporated into the structure of FIG. 1.

Referring also to FIG. 10, transparent, observation platform entertainment ride 400 positioned outside of structure 100 may include transparent walkway assembly 402 positioned away from offset core 102. Transparent, observation platform entertainment ride 400 may be positioned proximate an outside portion (e.g., outside portion 268) of offset core 102 and may allow riders (e.g., rider 404) to walk along transparent walkway assembly 402 and experience the sensation of floating.

Referring also to FIGS. 11A-11H, structure 100 may include a plurality of modules that are basically subcomponents that are assembled to form structure 100. For this particular example, structure 100 is shown to be formed from eight discrete modules.

Figure 11A:
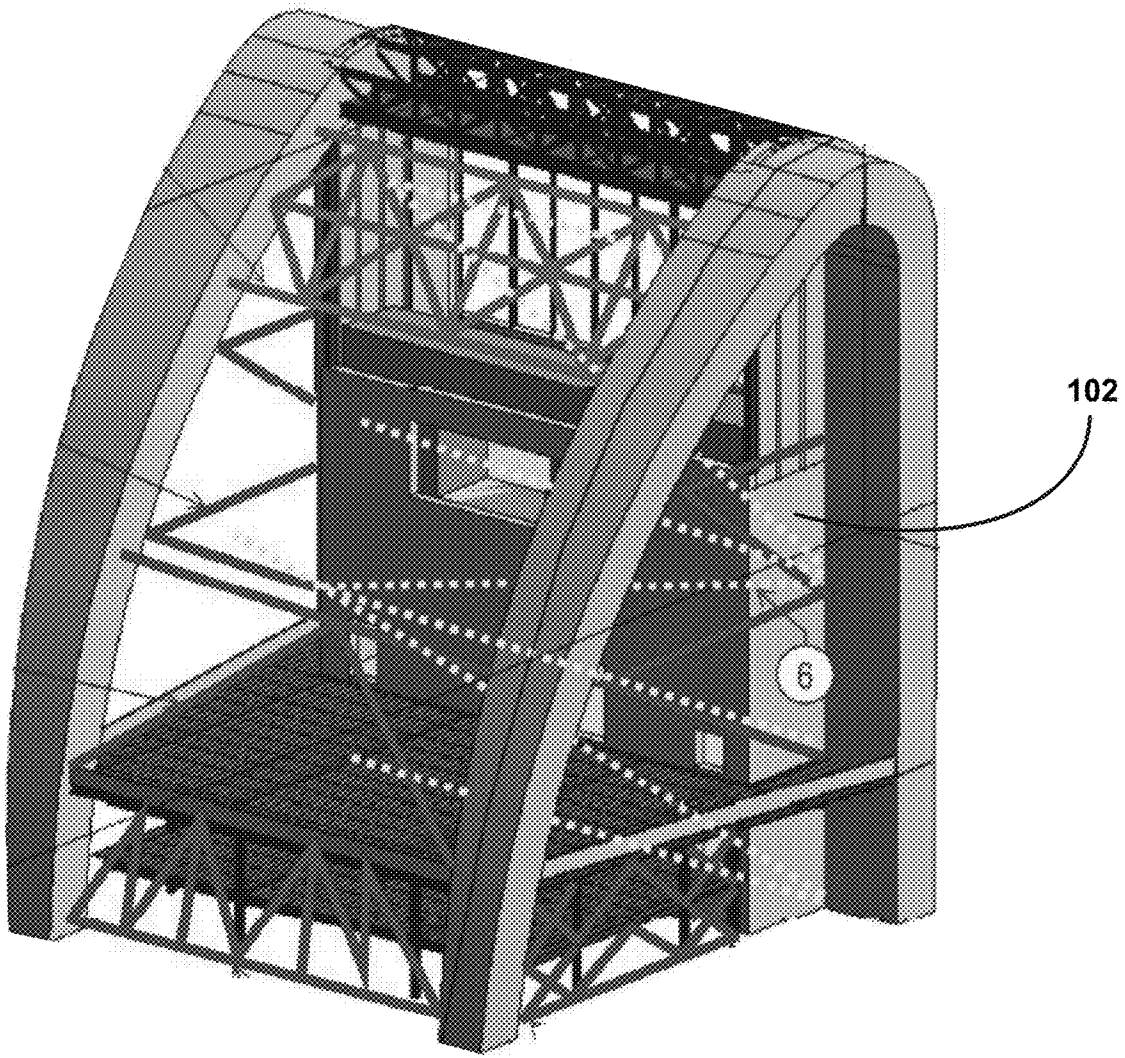
FIGS. 11A-11H are diagrammatic views of eight module assembly that make up a portion of the structure of FIG. 1.

FIG. 11A illustrates an example of first module 450 (i.e., the highest or top module) of structure 100; wherein first module 450 may be referred to as the "Rooftop Module".

Figure 11B:
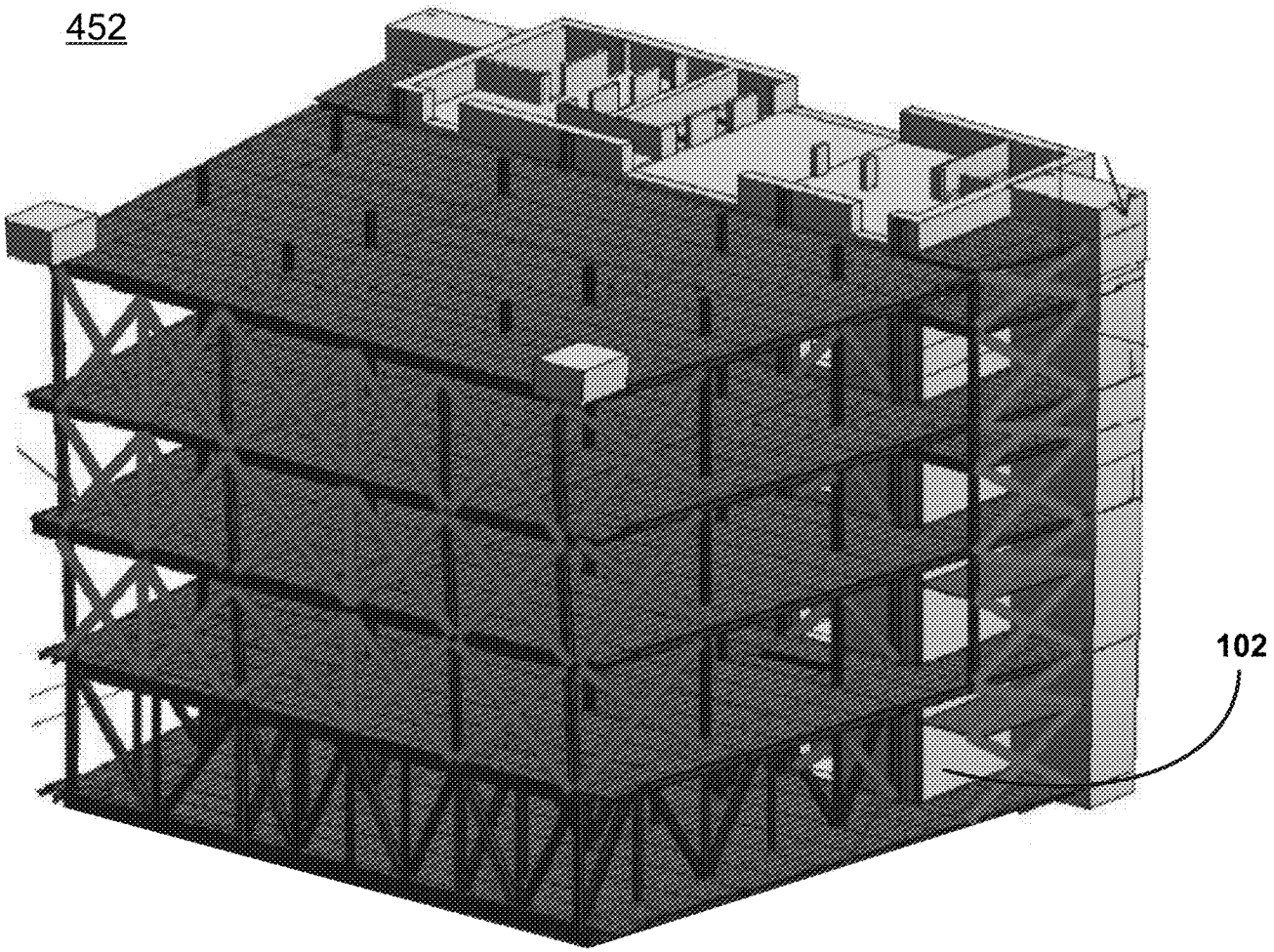

FIG. 11B illustrates an example of second module 452 (i.e., the module below module 450) of structure 100; wherein second module 452 may be referred to as the "VIP Module".

Figure 11C:
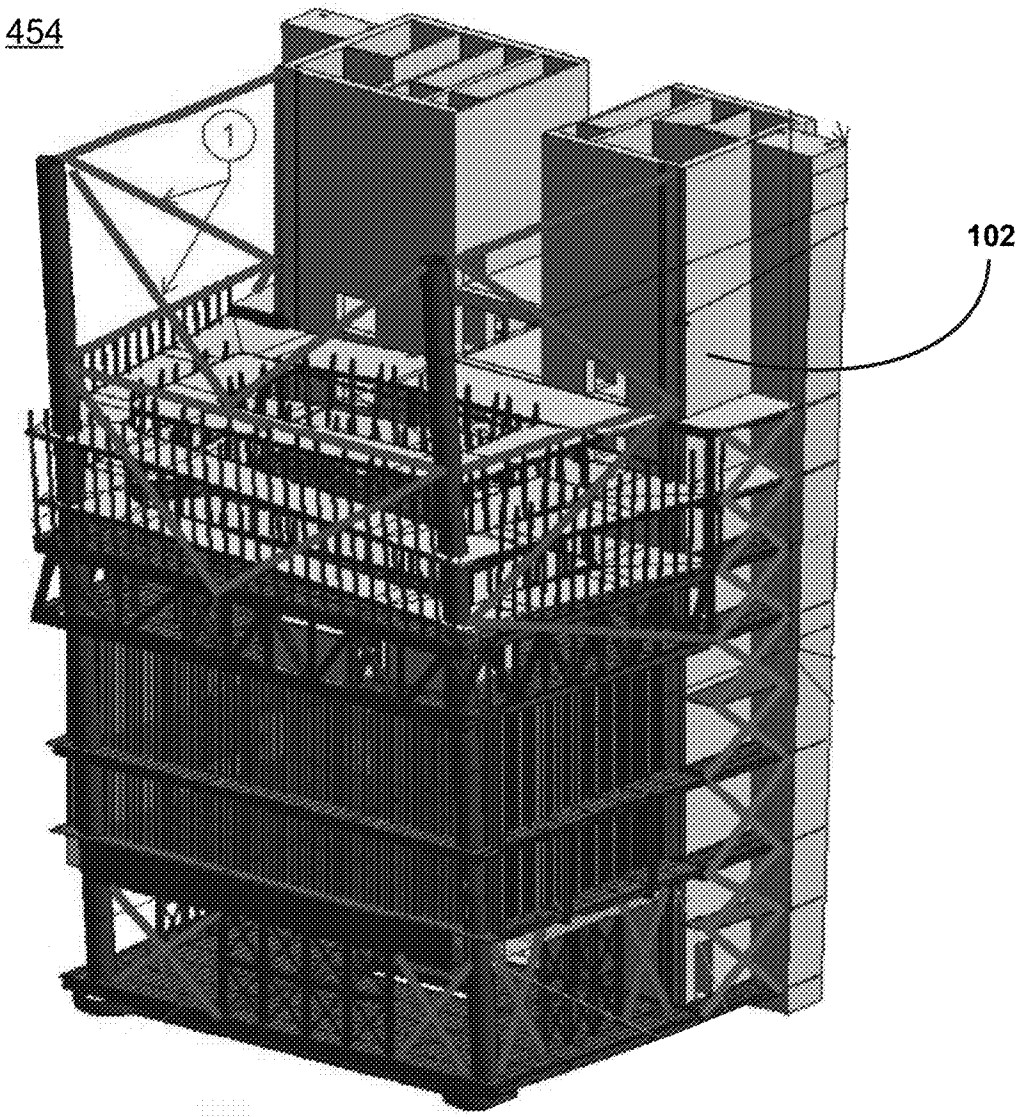

FIG. 11C illustrates an example of third module 454 (i.e., the module below module 452) of structure 100; wherein third module 454 may be referred to as the "Theater Module".

Figure 11D:
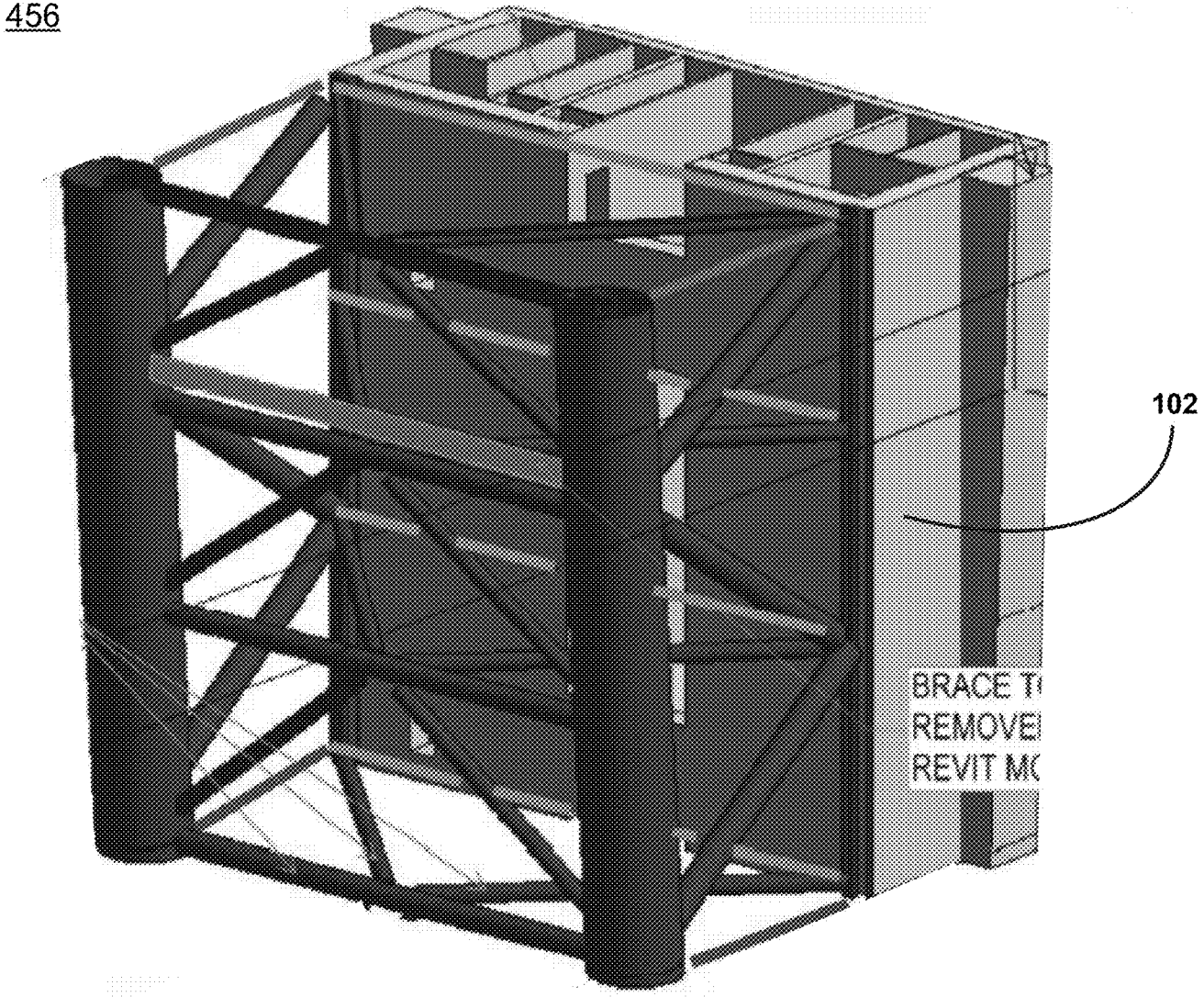

FIG. 11D illustrates an example of fourth module 456 (i.e., the module below module 454) of structure 100; wherein fourth module 456 may be referred to as the "Structural Module #1".

Figure 11E:
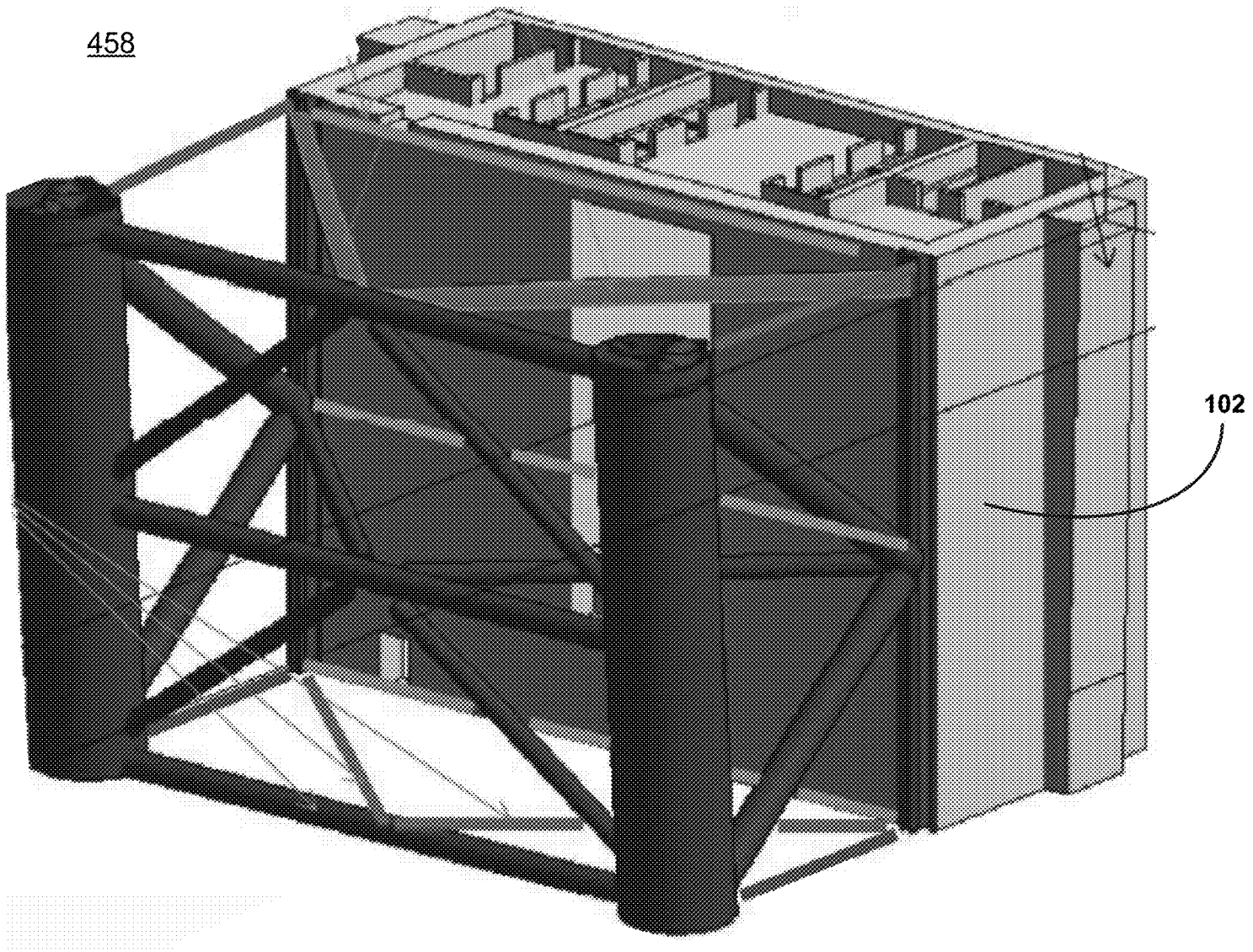

FIG. 11E illustrates an example of fifth module 458 (i.e., the module below module 456) of structure 100; wherein fifth module 458 may be referred to as the "Structural Module #2".

Figure 11F:
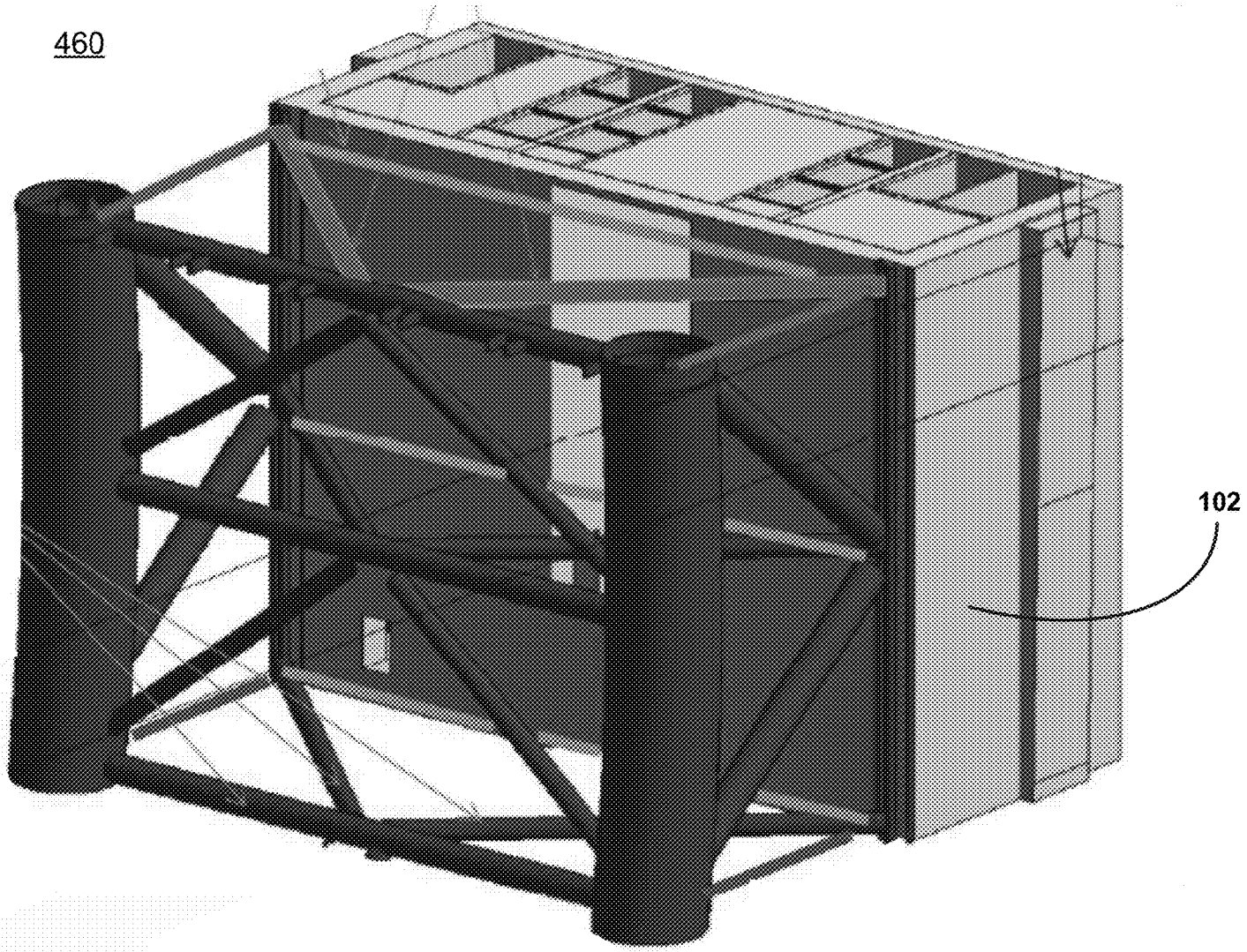

FIG. 11F illustrates an example of sixth module 460 (i.e., the module below module 458) of structure 100; wherein fifth module 458 may be referred to as the "Structural Module #3".

Figure 11G:
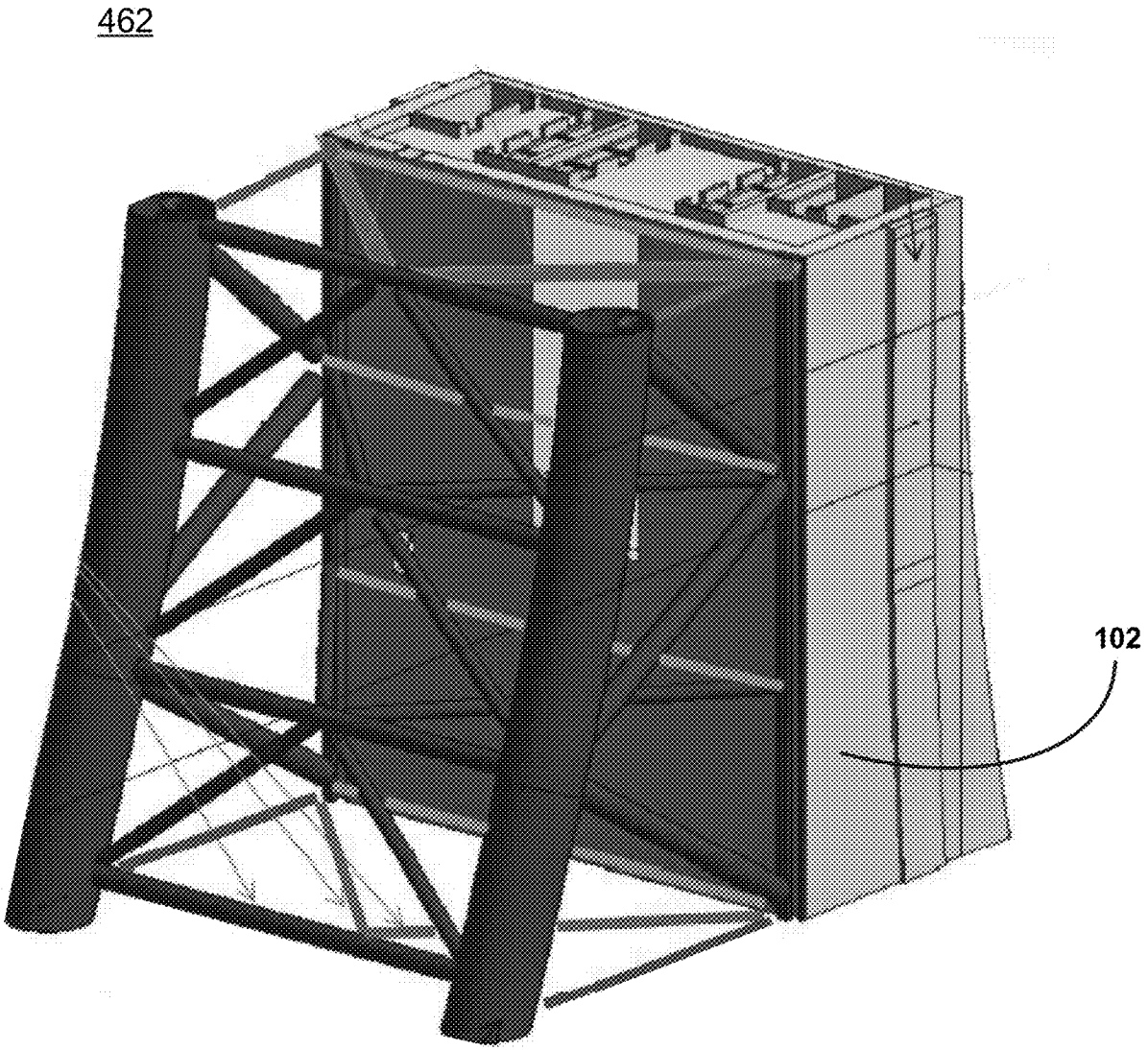

FIG. 11G illustrates an example of seventh module 462 (i.e., the module below module 460) of structure 100; wherein seventh module 462 may be referred to as the "Structural Module #4".

Figure 11H:
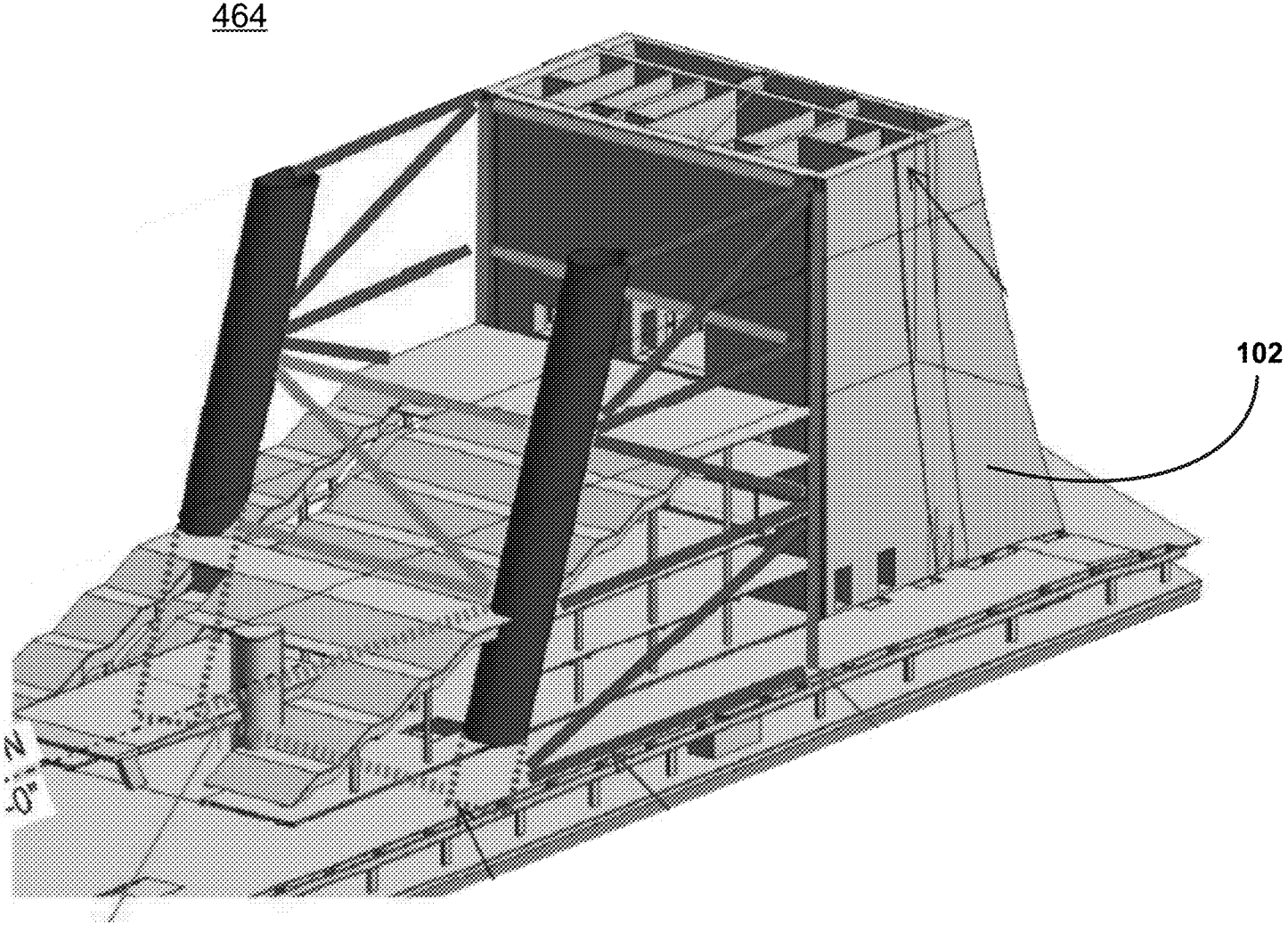

FIG. 11H illustrates an example of eighth module 464 (i.e., the lowest or bottom module) of structure 100; wherein eighth module 464 may be referred to as the "Structural Module #5".

While FIGS. 11A-11H show modules 450, 452, 454, 456, 458, 460, 462, 464 being coupled to offset core 102, this is for illustrative purposes only and is not intended to be a limitation of this disclosure. Specifically and as discussed above, offset core 102 may be unitary in nature, in that offset core 102 may be constructed using slip forming or continuous pouring technique. Accordingly, offset core 102 may first be constructed and then modules 450, 452, 454, 456, 458, 460, 462, 464 may be erected with respect to offset core 102.

One or more of the plurality of modules (e.g., modules 450, 452, 454, 456, 458, 460, 462, 464) may include one or more floor plate assemblies (e.g., plurality of floor plate assemblies 106). For example, module 450 (FIG. 11A), module 452 (FIG. 11B), and module 454 (FIG. 11C) are each shown to include one or more floor plate assemblies.

Figure 12:
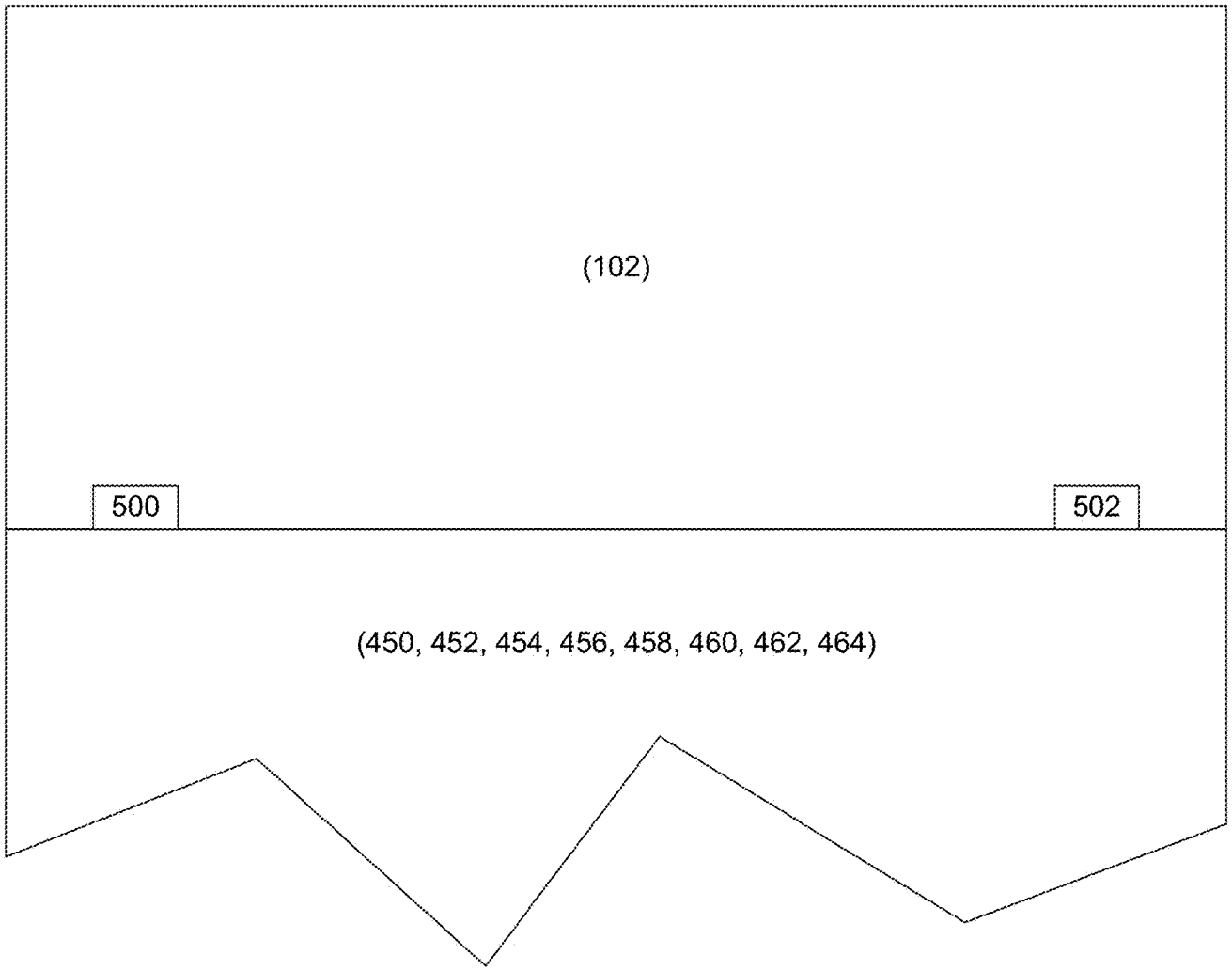
FIG. 12 is another cross-sectional view of the structure of FIG. 1.

Referring also to FIG. 12, there is shown a generic cross-sectional view of structure 100, wherein each of the plurality of modules (e.g., modules 450, 452, 454, 456, 458, 460, 462, 464) may be configured to slidable engage one or more essentially-vertical track assemblies (e.g., essentially-vertical track assemblies 500, 502) included within offset core 102, thus allowing for Z-axis movement (i.e., inward and outward movement with respect to the page) of the plurality of modules (e.g., modules 450, 452, 454, 456, 458, 460, 462, 464) during the construction process of structure 100. Essentially-vertical track assemblies 500, 502 may be embedded into offset core 102 and may be configured to run from the top of offset core 102 (i.e., the area proximate module 450 as shown in FIG. 11A) to the bottom of offset core 102 (i.e., the area proximate module 464 as shown in FIG. 11H).

Figure 13:
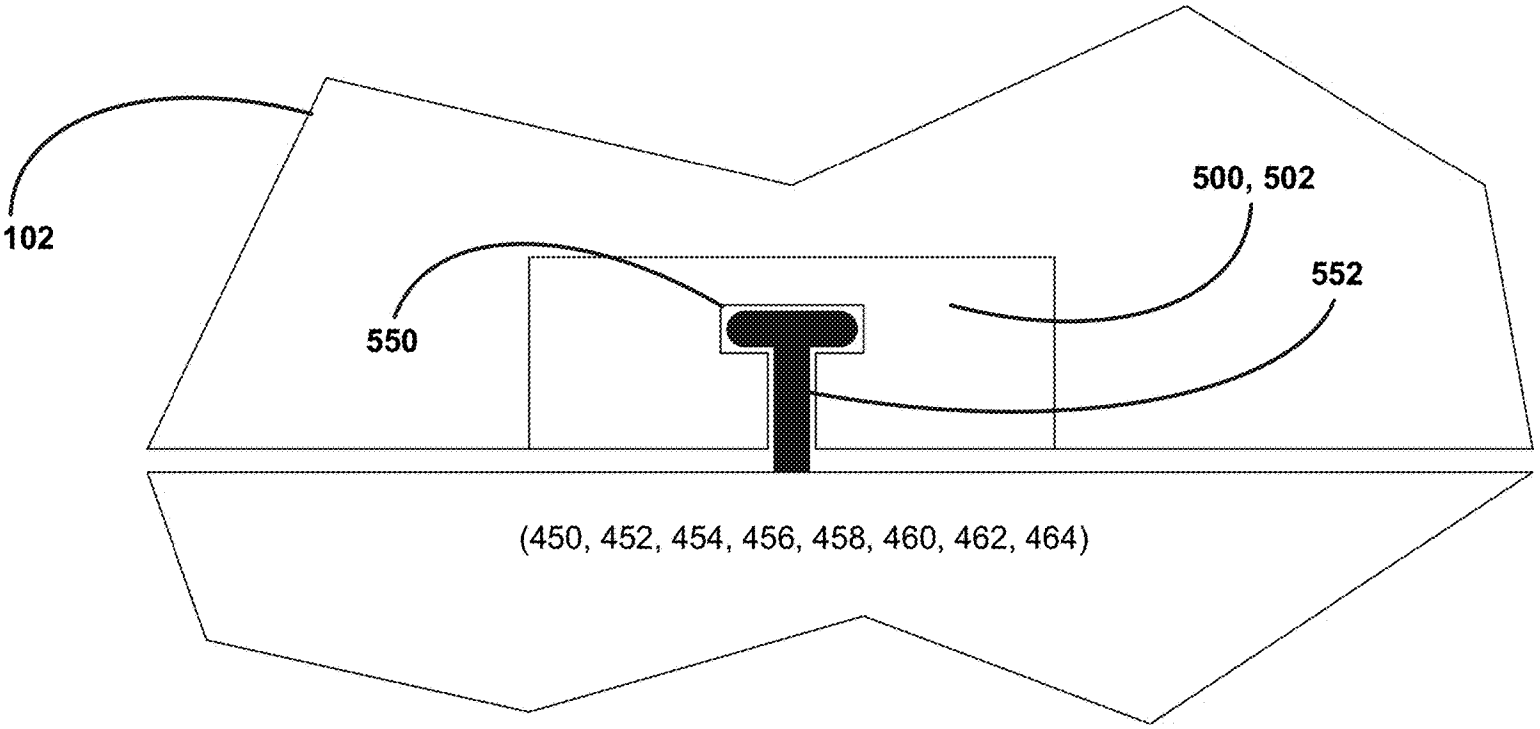
FIG. 13 is another cross-sectional view of a the structure of FIG. 1.
Figure 14:
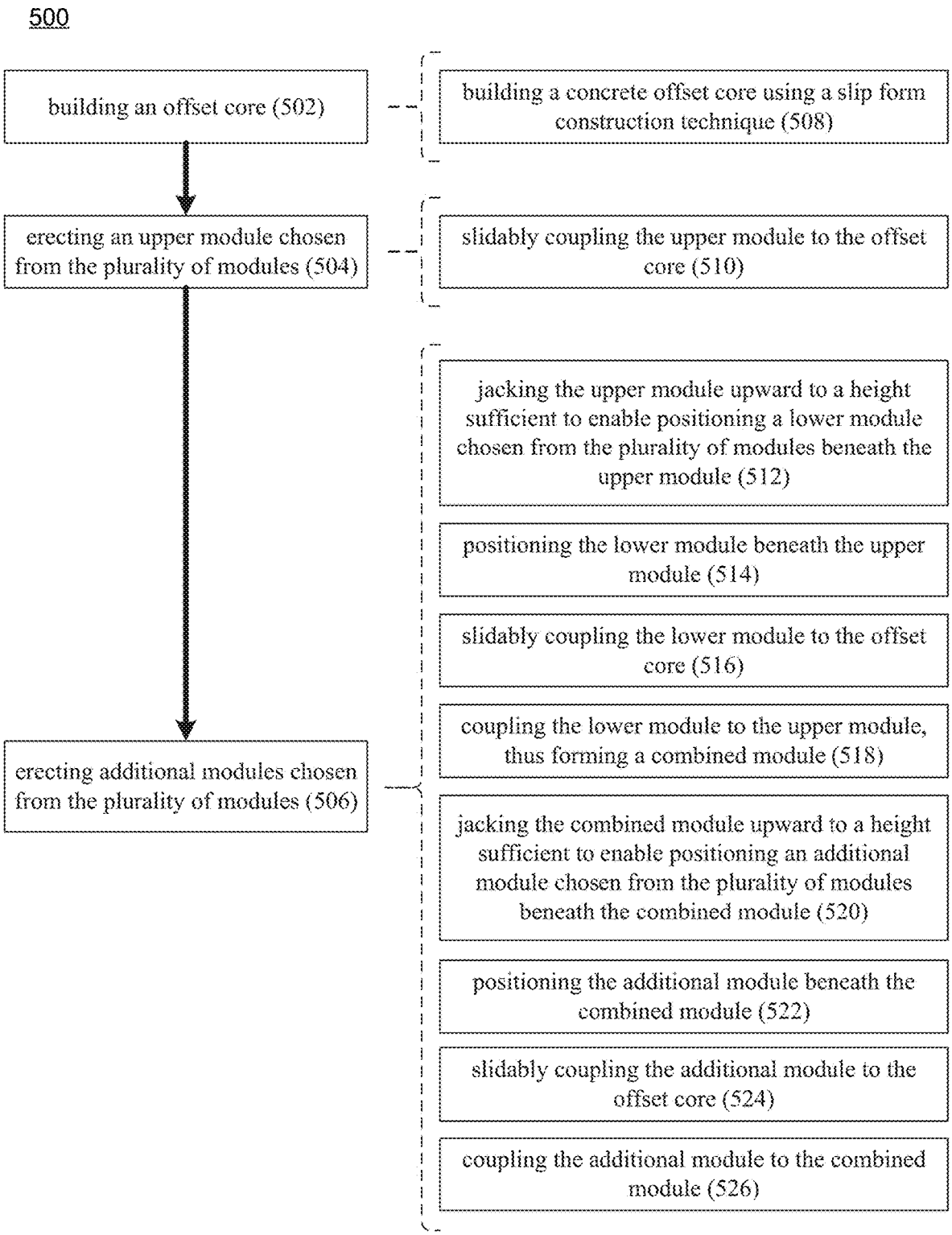
FIG. 14 is a flowchart of a method of constructing the structure of FIG. 1.

Referring also to FIG. 13, essentially-vertical track assemblies 500, 502 may include one or more t-shaped assemblies (e.g., t-shaped assemblies 550). The plurality of modules (e.g., modules 450, 452, 454, 456, 458, 460, 462, 464) may each include one or more t-shaped portions (e.g., t-shaped portions 552) for slidably engaging the one or more t-shaped assemblies (e.g., t-shaped assemblies 550) included within the one or more essentially-vertical track assemblies (e.g., essentially-vertical track assemblies 500, 502). Accordingly, the combination of the one or more t-shaped assemblies (e.g., t-shaped assemblies 550) included within the one or more essentially-vertical track assemblies (e.g., essentially-vertical track assemblies 500, 502) and the one or more t-shaped portions (e.g., t-shaped portions 552) included within the plurality of modules (e.g., modules 450, 452, 454, 456, 458, 460, 462, 464) may be configured to allow Z-axis movement (i.e., inward and outward movement with respect to the page) of the plurality of modules (e.g., modules 450, 452, 454, 456, 458, 460, 462, 464) during the construction process of structure 100, while preventing X-axis movement (i.e., left and right movement with respect to the page) and Y-axis movement (i.e., up and down movement with respect to the page) of the plurality of modules (e.g., modules 450, 452, 454, 456, 458, 460, 462, 464) during the construction of structure 100.

Referring also to FIGS. 14 and 15A-15H, there is shown construction method 500 for erecting structure 100 that includes the above-described plurality of modules (e.g., modules 450, 452, 454, 456, 458, 460, 462, 464). Method 500 may include building 502 offset core 102; erecting 504 an upper module (e.g., module 450) chosen from the plurality of modules (e.g., modules 450, 452, 454, 456, 458, 460, 462, 464) and erecting 506 additional modules (e.g., module 452, then module 454, then module 456, then module 458, then module 460, then module 462, then module 464) chosen from the plurality of modules (e.g., modules 450, 452, 454, 456, 458, 460, 462, 464).

When building 502 offset core 102, construction method 500 may build 508 a concrete offset core (e.g., offset core 102) using a slip form construction technique (as described above).

Figure 15A:
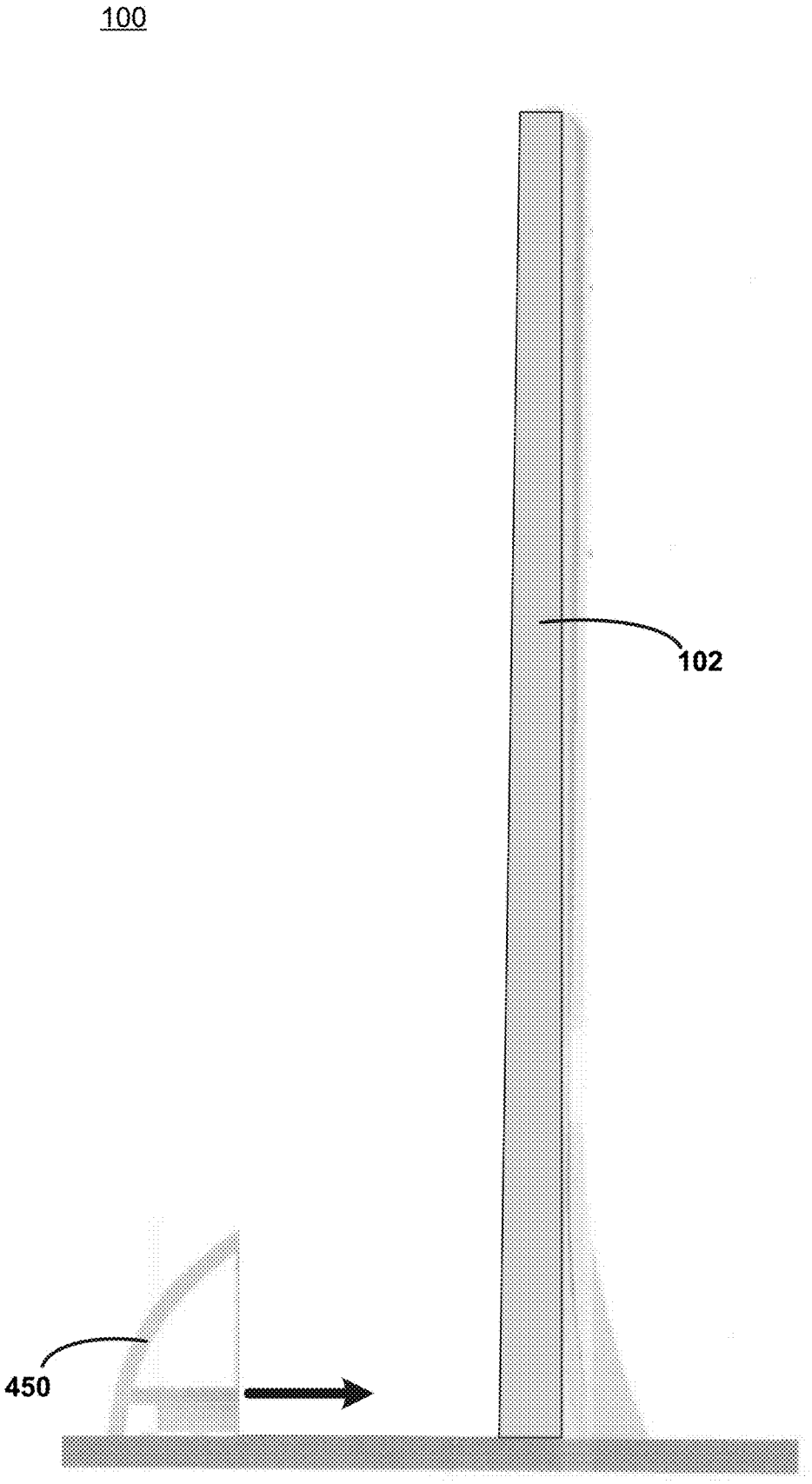
FIGS. 15A-15H are sequenced views of the construction of the structure of FIG. 1.

When erecting 504 the upper module (e.g., module 450) chosen from the plurality of modules (e.g., modules 450, 452, 454, 456, 458, 460, 462, 464), construction method 500 may slidably couple 510 the upper module (e.g., module 450) to offset core 102 (as shown in FIG. 15A).

Figure 15B:
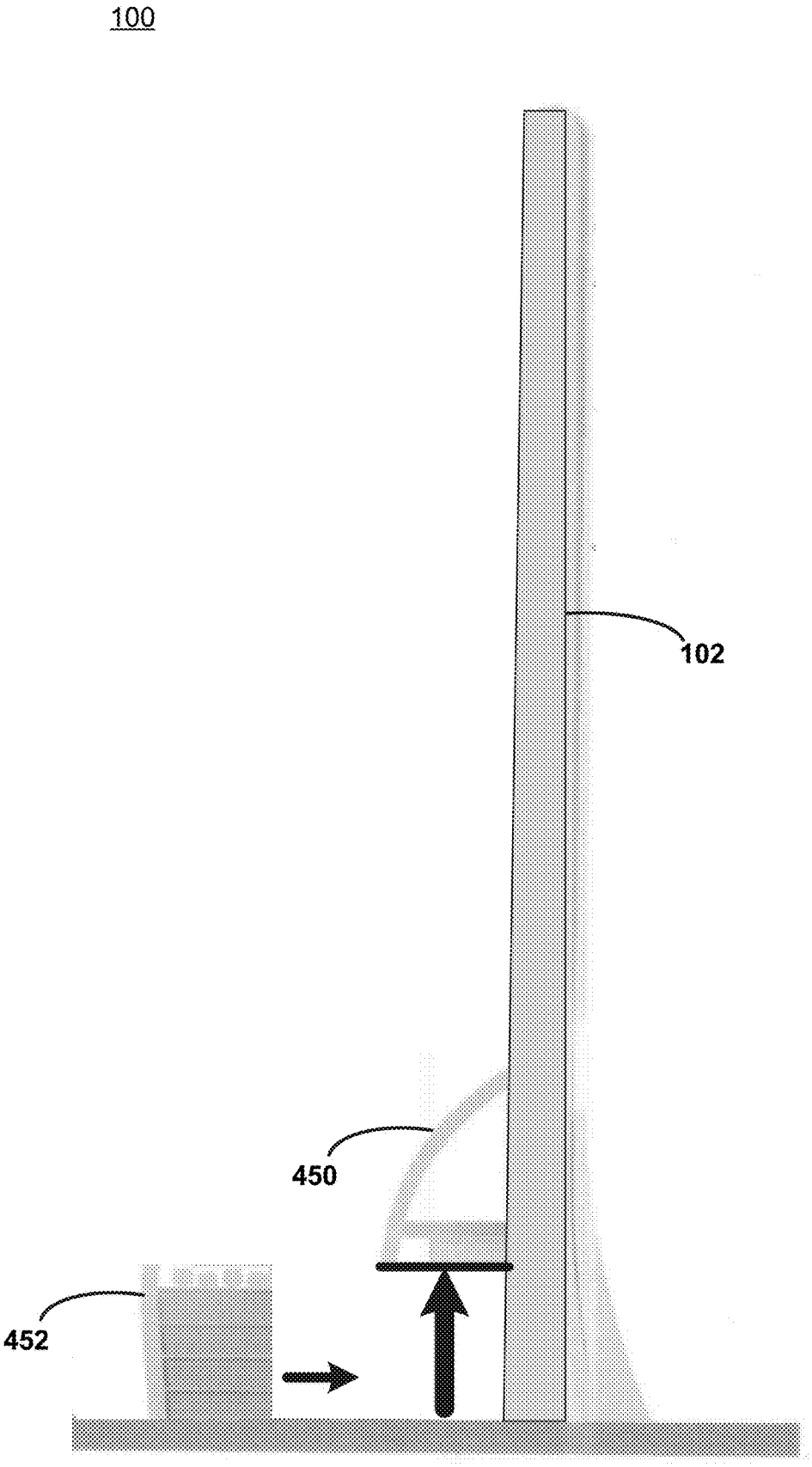
Figure 15C:
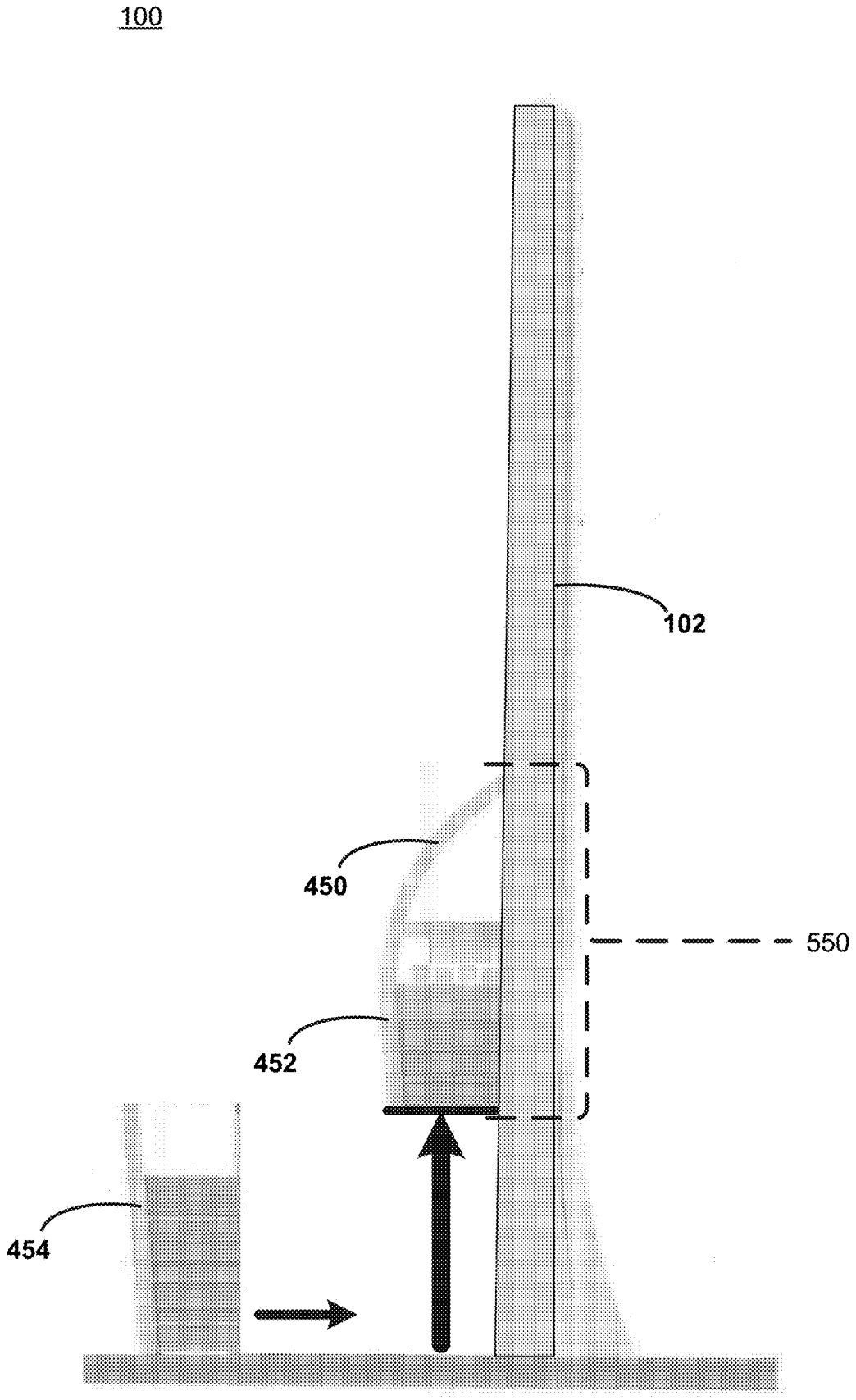

When erecting 506 additional modules (e.g., module 452, then module 454, then module 456, then module 458, then module 460, then module 462, then module 464) chosen from the plurality of modules (e.g., modules 450, 452, 454, 456, 458, 460, 462, 464), construction method 500 may: jack 512 the upper module (e.g., module 450) upward to a height sufficient to enable positioning a lower module (e.g., modules 452) chosen from the plurality of modules (e.g., modules 450, 452, 454, 456, 458, 460, 462, 464) beneath the upper module (e.g., module 450), as shown in FIG. 15B; position 514 the lower module (e.g., module 452) beneath the upper module (e.g., module 450), as shown in FIG. 15B; slidably couple 516 the lower module (e.g., module 452) to offset core 102, as shown in FIG. 15C; and couple 518 the lower module (e.g., module 452) to the upper module (e.g., module 450), thus forming combined module 550, as shown in FIG. 15C.

Figure 15D:
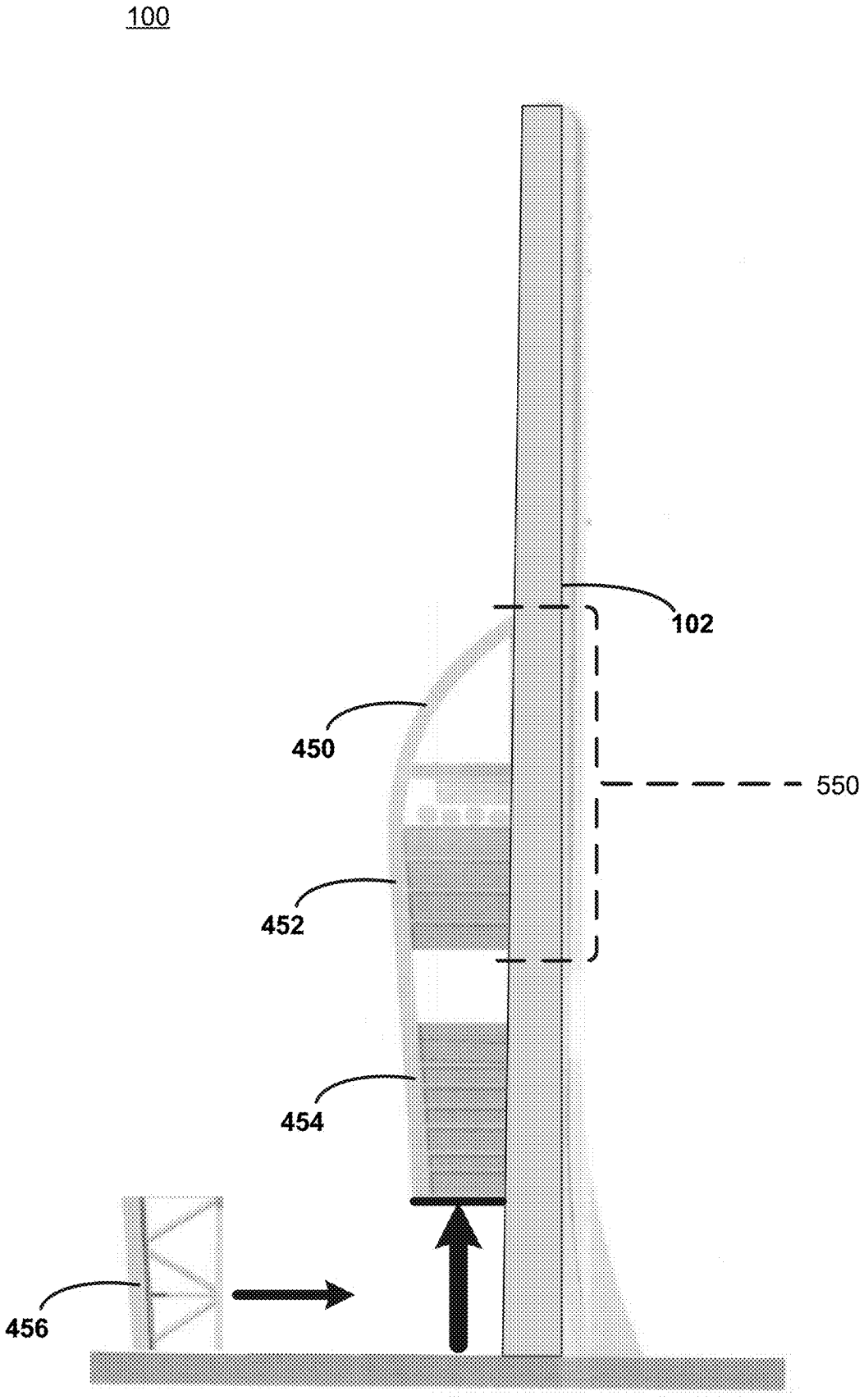
Figure 15E:
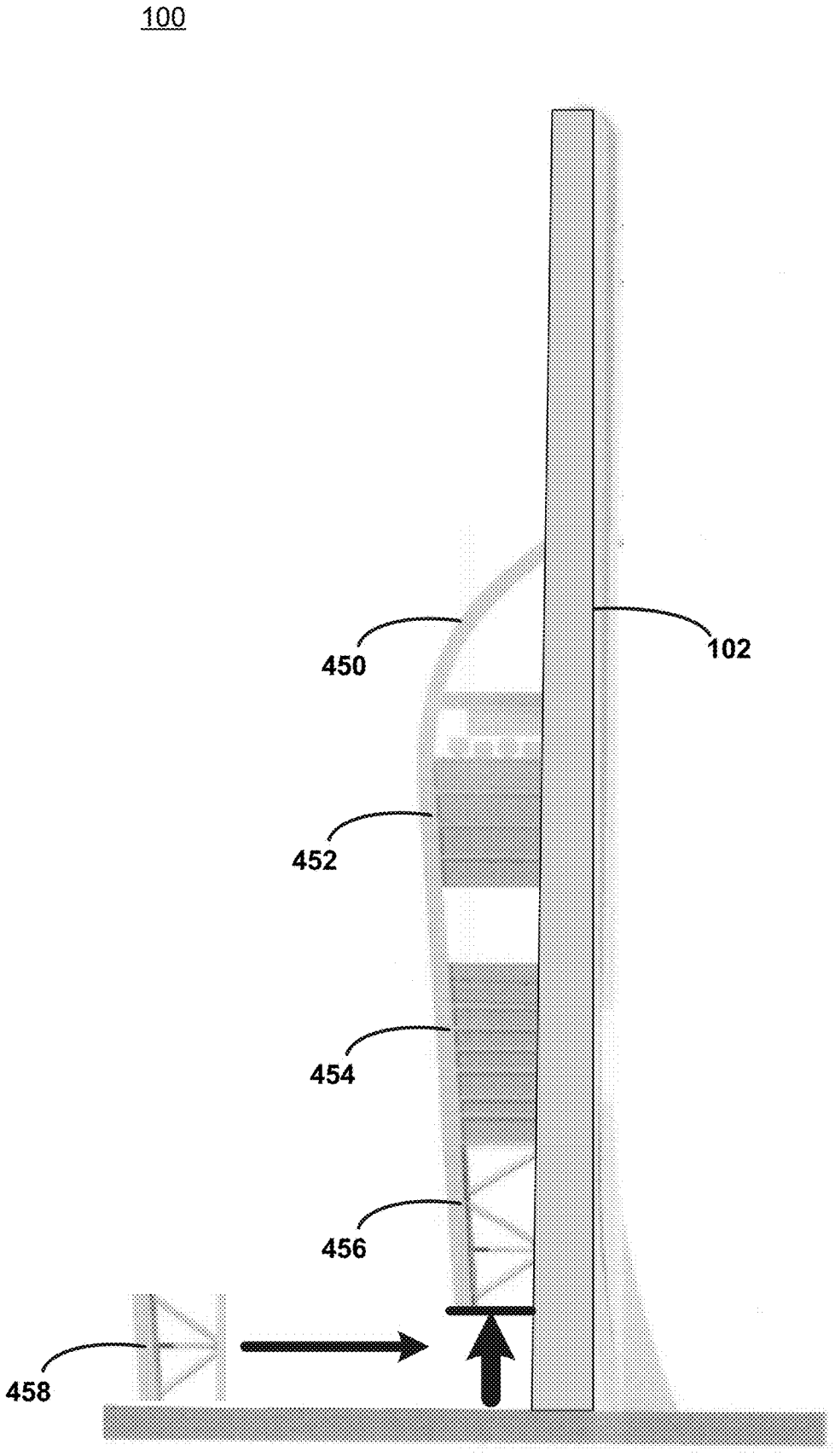
Figure 15F:
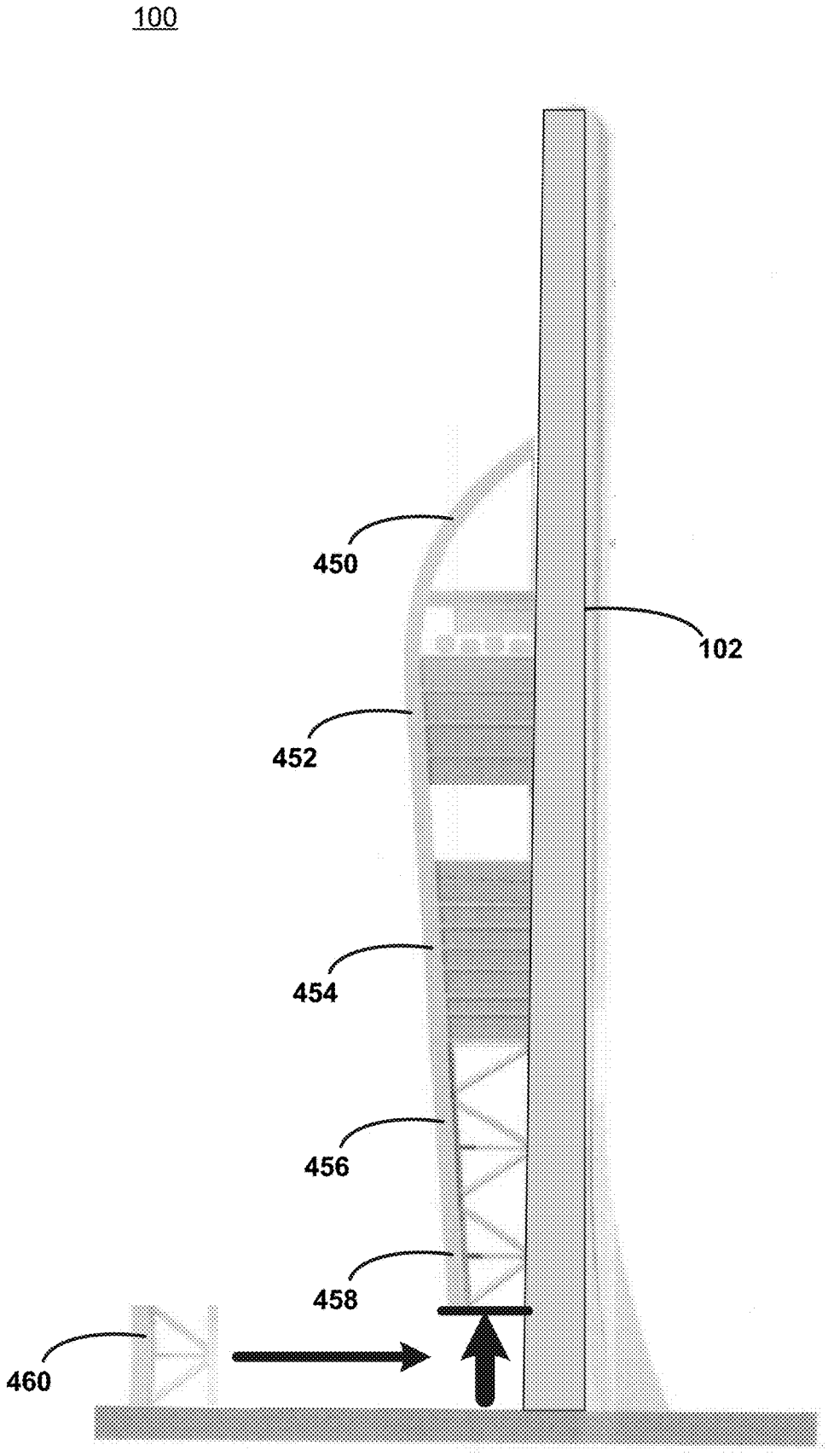
Figure 15G:
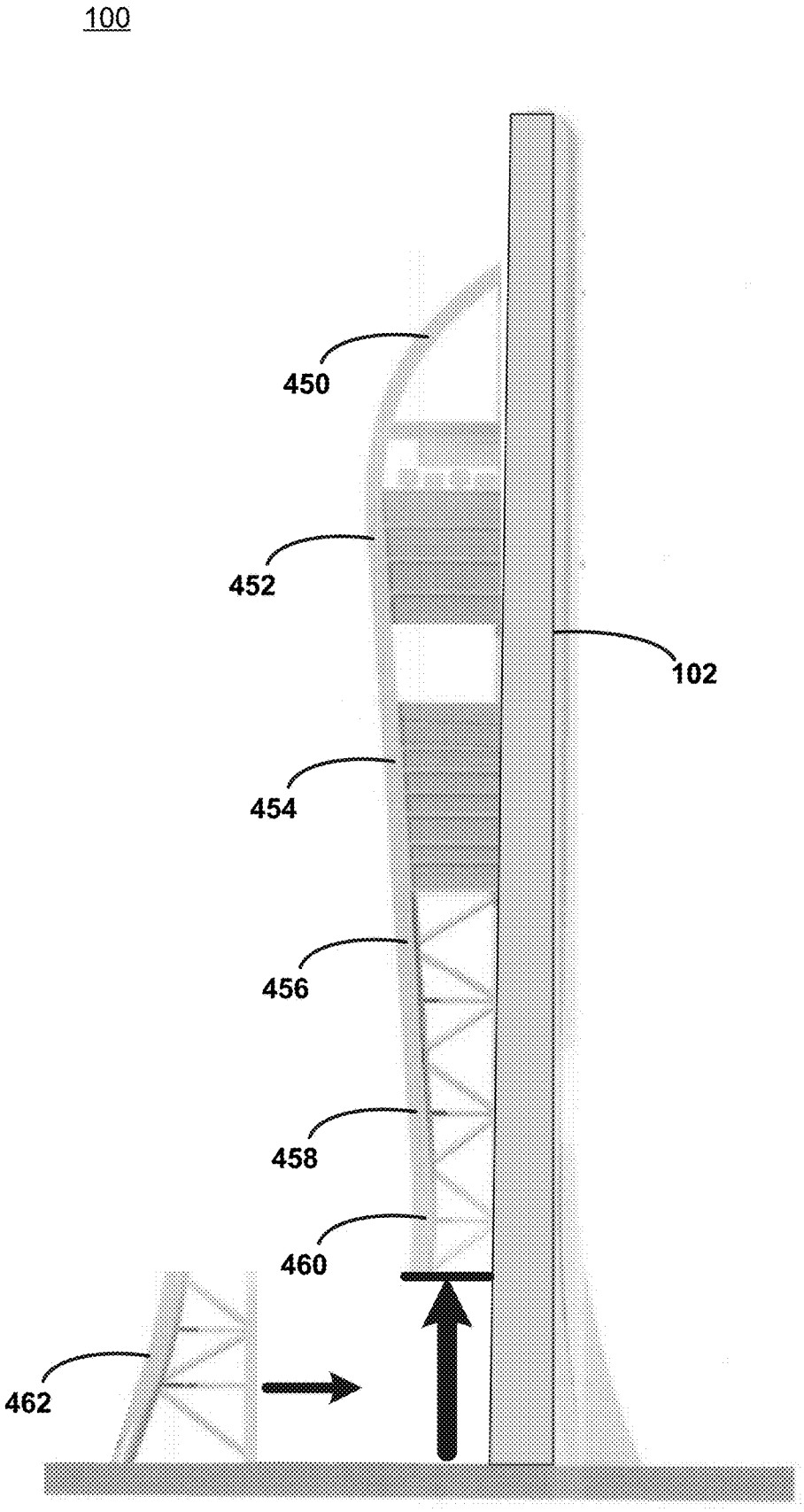
Figure 15H:
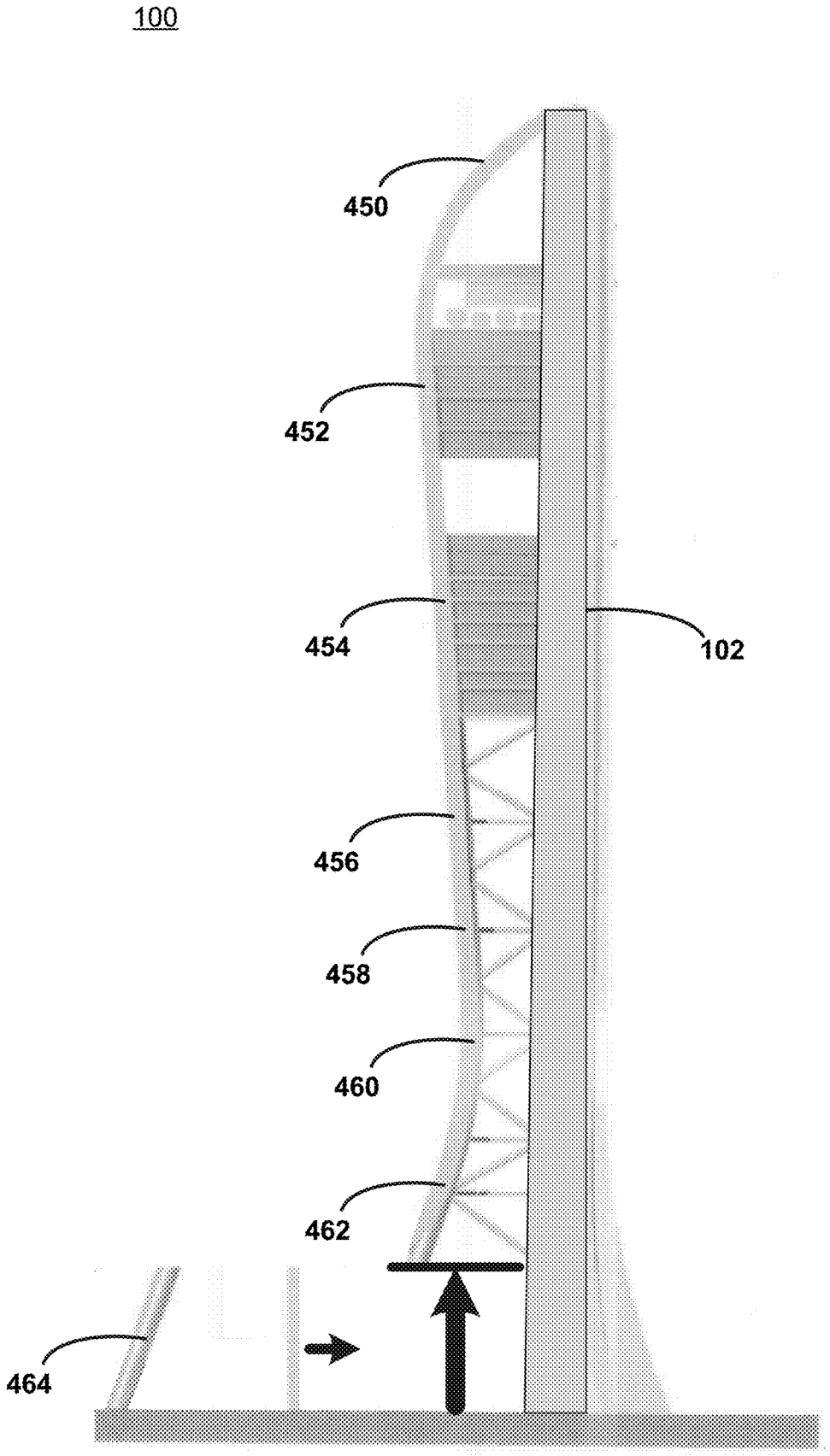

When erecting 506 additional modules (e.g., module 452, then module 454, then module 456, then module 458, then module 460, then module 462, then module 464) chosen from the plurality of modules (e.g., modules 450, 452, 454, 456, 458, 460, 462, 464), construction method 500 may also: jack 520 combined module 550 upward to a height sufficient to enable positioning an additional module (e.g., module 454) chosen from the plurality of modules (e.g., modules 450, 452, 454, 456, 458, 460, 462, 464) beneath combined module 550, as shown in FIG. 15C; position 522 the additional module (e.g., module 454) beneath combined module 550, as shown in FIG. 15D; slidably couple 524 the additional module (e.g., module 454) to offset core 102, as shown in FIG. 15D; and couple 526 the additional module (e.g., module 454) to combined module 550, as shown in FIG. 15D. The above-described construction method may be repeated (as shown in FIGS. 15E-15H) until the construction of structure 100 is complete.

General:

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. A vertical entertainment structure comprising:

an offset core positioned proximate a periphery of a back wall of the vertical entertainment structure;

a moment stabilizing structure, wherein the offset core is offset from the moment stabilizing structure;

a plurality of floor plate assemblies; and three or more entertainment rides that each span at least two of the plurality of floor plate assemblies, wherein at least one of the three or more entertainment rides include:

a tethered, freefall entertainment ride positioned within the vertical entertainment structure and between the offset core and the moment stabilizing structure.

2. The vertical entertainment structure of claim 1 wherein the plurality of floor plate assemblies each include:

a first edge; and a second edge;

wherein the first edge of each of the plurality of floor plate assemblies is configured to be coupled to the offset core and the second edge of each of the plurality of floor plate assemblies is configured to be coupled to the moment stabilizing structure.

3. The vertical entertainment structure of claim 2 wherein the moment stabilizing structure includes:

a truss assembly; and a floor tying assembly.

4. The vertical entertainment structure of claim 3 wherein the truss assembly includes at least one essentially diagonal brace assembly.

5. The vertical entertainment structure of claim 3 wherein the floor tying assembly is configured to index the plurality of floor plate assemblies with respect to each other and transfer the load of the plurality of floor plate assemblies to the truss assembly.

6. The vertical entertainment structure of claim 2 wherein the first edge of the plurality of floor plate assemblies is essentially opposite to the second edge of the plurality of floor plate assemblies.

7. The vertical entertainment structure of claim 1 wherein the offset core is a concrete offset core.

8. The vertical entertainment structure of claim 7 wherein the concrete offset core is a slip-formed concrete offset core.

9. The vertical entertainment structure of claim 1 wherein the offset core is configured to include one or more of:

one or more elevator assemblies;

one or more ventilation assemblies; and one or more stair assemblies.

10. The vertical entertainment structure of claim 1 wherein at least one of the plurality of floor plate assemblies positioned toward the top of the entertainment structure is larger than at least one of the plurality of floor plate assemblies positioned toward the bottom of the entertainment structure.

11. The vertical entertainment structure of claim 1 wherein the three or more entertainment rides include one or more of:

a moveable, observation pod entertainment ride positioned outside of the vertical entertainment structure;

a track-based, freefall entertainment ride positioned outside of the vertical entertainment structure; and a transparent, observation platform entertainment ride positioned outside of the vertical entertainment structure.

12. A vertical entertainment structure comprising:

an offset core positioned proximate a periphery of a back wall of the vertical entertainment structure;

a moment stabilizing structure;

a plurality of floor plate assemblies; and three or more entertainment rides that each span at least two of the plurality of floor plate assemblies, wherein at least one of the three or more entertainment rides include:

a tethered, freefall entertainment ride positioned within the vertical entertainment structure and between the offset core and the moment stabilizing structure.

13. The vertical entertainment structure of claim 12 wherein the moment stabilizing structure includes:

a truss assembly; and a floor tying assembly.

14. The vertical entertainment structure of claim 12 wherein the offset core is configured to include one or more of:

one or more elevator assemblies;

one or more ventilation assemblies; and one or more stair assemblies.

15. The vertical entertainment structure of claim 12 wherein at least one of the plurality of floor plate assemblies positioned toward the top of the entertainment structure is larger than at least one of the plurality of floor plate assemblies positioned toward the bottom of the entertainment structure.

16. The vertical entertainment structure of claim 12 wherein the three or more entertainment rides include one or more of:

a moveable, observation pod entertainment ride positioned outside of the vertical entertainment structure;

a track-based, freefall entertainment ride positioned outside of the vertical entertainment structure; and a transparent, observation platform entertainment ride positioned outside of the vertical entertainment structure.

17. A vertical entertainment structure comprising:

an offset core positioned proximate a periphery of a back wall of the vertical entertainment structure;

a moment stabilizing structure;

a plurality of floor plate assemblies, wherein each of the plurality of floor plate assemblies includes a first edge and a second edge, wherein the first edge of each of the plurality of floor plate assemblies is configured to be coupled to the offset core and the second edge of each of the plurality of floor plate assemblies is configured to be coupled to the moment stabilizing structure; and three or more entertainment rides that each span at least two of the plurality of floor plate assemblies, wherein at least one of the three or more entertainment rides include:

a moveable, observation pod entertainment ride positioned outside of the vertical entertainment structure;

a tethered, freefall entertainment ride positioned within the vertical entertainment structure and between the offset core and the moment stabilizing structure;

a track-based, freefall entertainment ride positioned outside of the vertical entertainment structure; and a transparent, observation platform entertainment ride positioned outside of the vertical entertainment structure.

18. The vertical entertainment structure of claim 17 wherein the moment stabilizing structure includes:

a truss assembly; and a floor tying assembly.

19. The vertical entertainment structure of claim 18 wherein the truss assembly includes at least one essentially diagonal brace assembly.

20. The vertical entertainment structure of claim 18 wherein the floor tying assembly is configured to index the plurality of floor plate assemblies with respect to each other and transfer the load of the plurality of floor plate assemblies to the truss assembly.

* * * * *